US011839574B2

(12) United States Patent
Albino

(10) Patent No.: US 11,839,574 B2
(45) Date of Patent: Dec. 12, 2023

(54) SPLIT BASE PLATE ASSEMBLY USING PINS

(71) Applicant: Innovative Medical Products, Inc., Plainville, CT (US)

(72) Inventor: Scott A. Albino, Southington, CT (US)

(73) Assignee: Innovative Medical Products, Inc., Plainville, CT (US)

( * ) Notice: Subject to any disclaimer, the term of this patent is extended or adjusted under 35 U.S.C. 154(b) by 510 days.

(21) Appl. No.: 17/187,755

(22) Filed: Feb. 27, 2021

(65) Prior Publication Data

US 2022/0273512 A1 Sep. 1, 2022

(51) Int. Cl.

| | |
|---|---|
| ***A61G 13/10*** | (2006.01) |
| ***A61G 13/12*** | (2006.01) |
| ***A61G 7/065*** | (2006.01) |
| ***A61G 7/075*** | (2006.01) |

(52) U.S. Cl.

CPC ..... *A61G 13/101* (2013.01); *A61G 7/065* (2013.01); *A61G 13/1245* (2013.01); *A61G 7/075* (2013.01)

(58) Field of Classification Search

CPC ..... A61G 13/101; A61G 13/10; A61G 7/065; A61G 7/075; A61G 7/0755; A61G 13/1245; A61G 13/1205; A61G 13/12

USPC ..... 5/621, 624, 648

See application file for complete search history.

(56) References Cited

U.S. PATENT DOCUMENTS

| | | | | |
|---|---|---|---|---|
| 4,232,681 | A | 11/1980 | Tulaszewski | |
| 6,058,534 | A | 5/2000 | Navarro et al. | |
| 7,003,827 | B2 * | 2/2006 | DeMayo | F16M 11/045 5/601 |
| 7,380,299 | B1 * | 6/2008 | DeMayo | A61G 13/0063 5/624 |
| 8,782,832 | B2 * | 7/2014 | Blyakher | A61B 6/0421 5/624 |
| 9,603,765 | B2 | 3/2017 | Kreuzer et al. | |
| 9,615,987 | B2 | 4/2017 | Worm et al. | |
| 10,357,416 | B2 * | 7/2019 | Cole | A61G 13/125 |
| 10,842,698 | B2 * | 11/2020 | Blackwell | A61G 13/1245 |
| D986,437 | S * | 5/2023 | Albino | D24/231 |
| D987,109 | S * | 5/2023 | Kovacs | D24/231 |
| 2005/0278851 | A1 * | 12/2005 | DeMayo | F16M 13/02 5/624 |
| 2011/0170671 | A1 * | 7/2011 | Blyakher | A61B 6/0421 378/208 |

(Continued)

FOREIGN PATENT DOCUMENTS

| | | | | |
|---|---|---|---|---|
| WO | WO-2022182563 | A1 * | 9/2022 | A61G 13/101 |

*Primary Examiner* — Robert G Santos

(74) *Attorney, Agent, or Firm* — Wasserbauer Law LLC; Damian G. Wasserbauer; Nicholas E. Blanton

(57) ABSTRACT

This disclosure pertains to a separable base plate assembly configured to securely attached to a side rail of an operating room table and to hold, move, and maintain a body part in a specific position as needed in orthopedic surgery. The separable base plate assembly is further configured to decouple into separate parts to facilitate sterilization of said parts, after an orthopedic surgery is performed. The separable base plate assembly may comprise two or more base portions including track portions, a base plate connector, drop pins, and associated components adapted for securing the assembly, which in turn is configured to be assembled to a clamp that rigidly attaches the assembly to the operating room table side rail.

21 Claims, 19 Drawing Sheets

(56) References Cited

U.S. PATENT DOCUMENTS

| | | | | |
|---|---|---|---|---|
| 2013/0019883 | A1* | 1/2013 | Worm | A61G 13/125 128/882 |
| 2015/0238380 | A1* | 8/2015 | Kreuzer | A61G 13/1295 5/648 |
| 2016/0346150 | A1* | 12/2016 | Blackwell | A61G 13/129 |
| 2017/0252249 | A1* | 9/2017 | Cole | A61G 13/125 |
| 2022/0273512 | A1* | 9/2022 | Albino | A61G 7/065 |

* cited by examiner

130

130

SPLIT BASE PLATE ASSEMBLY USING PINS

TECHNICAL FIELD

The present invention relates to positioner devices and, more specifically, to a separable base plate configured to hold, move, and maintain a body part in a specific position as needed in orthopedic surgery; the separable base plate is further configured to decouple into separate parts to facilitate sterilization of said parts, after an orthopedic surgery is performed.

BACKGROUND OF THE INVENTION

U.S. Pat. No. 5,462,551 entitled "Knee Positioner" describes limb surgery on the human body including knees, knee replacement, fracture repair, as well as similar hand, foot, and ankle surgery such that the join or limb to be operated on is precisely and predictably position during such surgery. U.S. Pat. No. 7,380,299 entitled "Operating Table Support Clamp" describes a support platform and operating table clamp that connects to an operating table.

A problem exists with conventional surgery systems in that the hardware and associated components are not easily sterilizable, e.g. the base plate can be 28-42 inches. Typically, sterilizer systems consist of a cabinet with a series of trays or slots in which such hardware and associated components can be placed to be sterilized; these sterilizer systems are commonly limited to accept items that fit within trays 24"×11.5"×8" (depth, width, and height, respectively). Conventional base plates with a length of plus 24 inches occupy multiple trays when inserted into the sterilization cabinet, e.g. 6 tray bays. The sterilization cabinets are also used for storage of sterilized systems. Consequently, there is a long-felt need to overcome these space and sterilization disadvantages of conventional positioner systems. Conventional surgery systems, typically, either require a multitude of sterilization trays (making the sterilization process unnecessarily cumbersome), or that consist of certain components that do not fit within the sterilization trays altogether (further complicating the sterilization process).

It would therefore be functionally and economically advantageous to provide a knee positioner system that overcomes these challenges.

SUMMARY OF THE INVENTION

A functionally and economically advantageous knee positioner system that can be efficiently sterilized and stored is described. The knee positioner invention has a separable base plate, which can operatively connect for use during surgery, and which can decouple into separate parts to facilitate sterilization.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
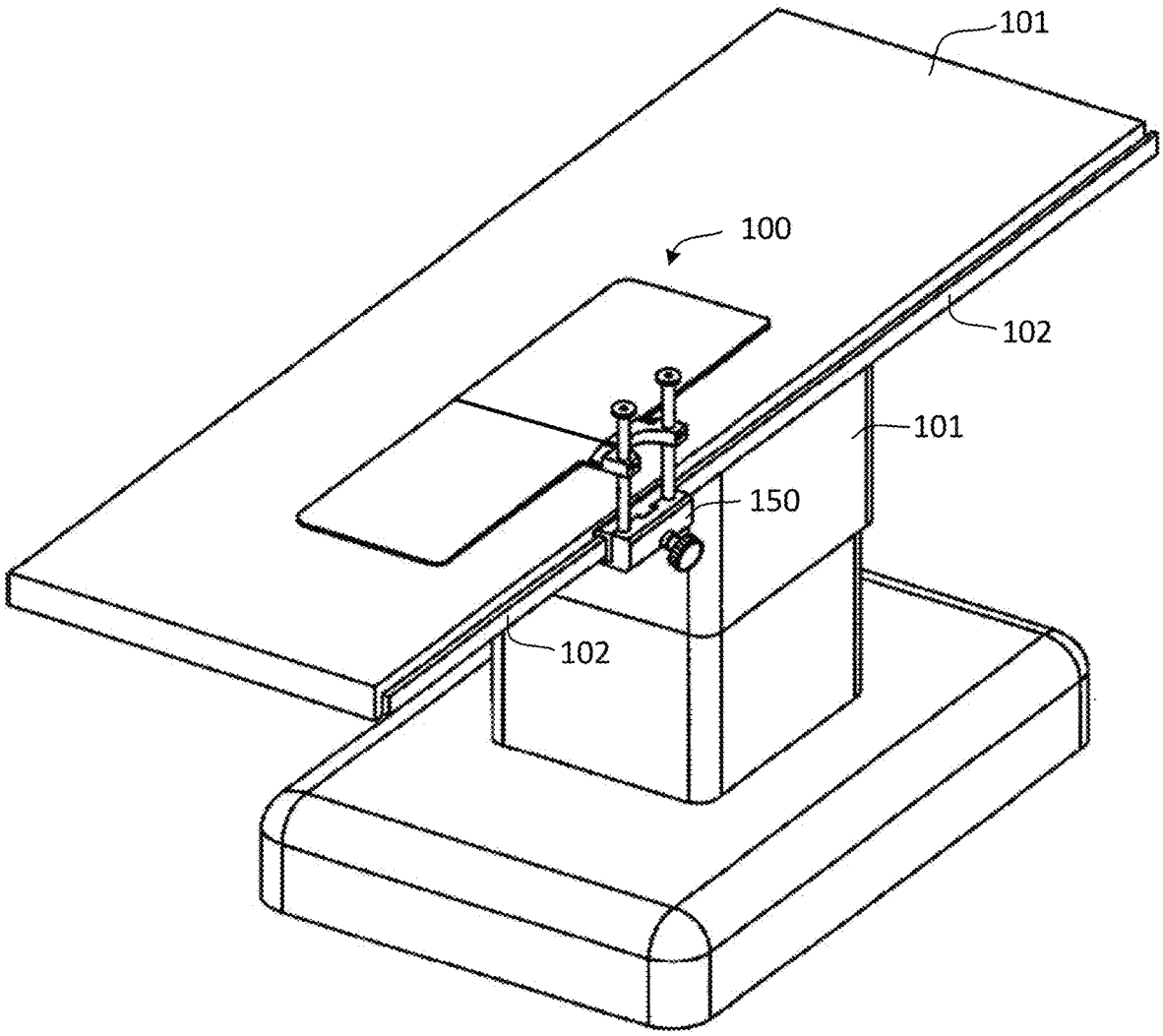
FIG. 1 illustrates an environment of operation of the limb/knee positioner having a solid and/or a separable base plate in accordance with an embodiment of the apparatus, system and method present invention operation.
Figure 2:
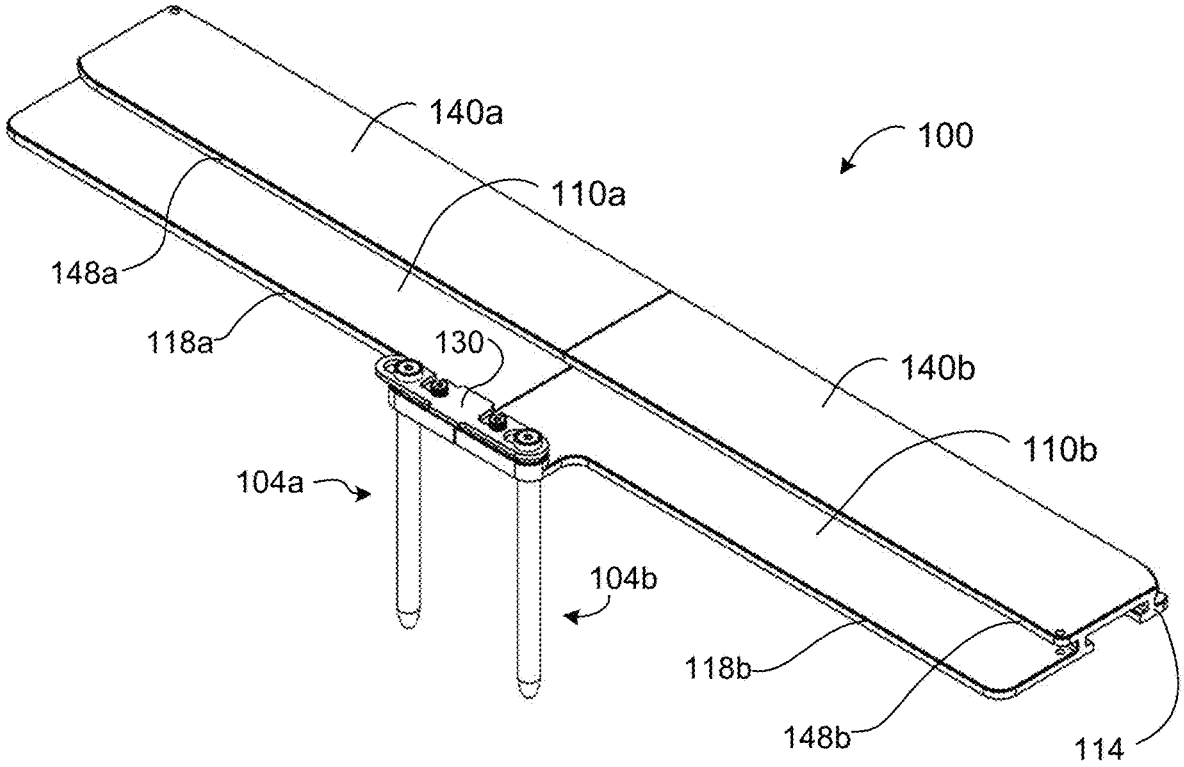
FIG. 2 illustrates a perspective view of a separable base plate apparatus, system and method in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As is illustrated in FIGS. 1 through 21B, a separable base plate for a positioner apparatus, system and method is generally shown as element 100. A separable base plate 100 may be used as illustrated in the schematic view in FIG. 1. The separable base plate 100 is configured to be set atop a support table or operating room table (OR table) 101 and attached to a side rail 102 using a clamp assembly 150, which works in conjunction with first and second drop pin assemblies, 104*a* and 104*b*, respectively. Clamp assembly 150 may be operably connected to the OR table 101 at side rail 102 by a suitable design such as a 713 Series clamp manufactured by Innovative Medical Products, Inc., a spring-loaded lever clamp (shown schematically, in FIG. 1), or by another suitable clamp adapted with a pin-locking mechanism such as an equalizer clamp described in U.S. patent application Ser. No. 17/073,334, filed Oct. 17, 2020, which claims benefit to U.S. Prov. App. No. 62/916,674, filed Oct. 17, 2019.

Figure 3:
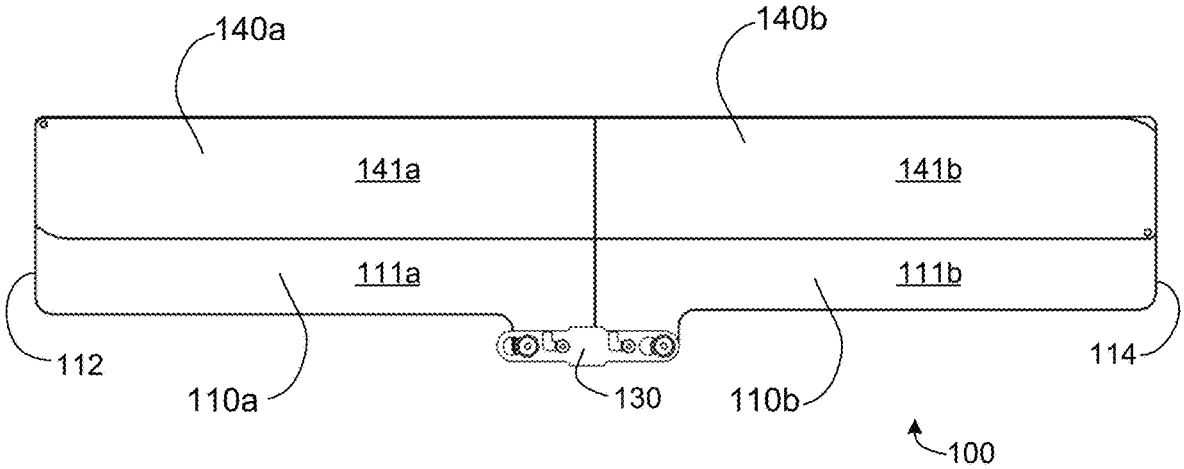
FIG. 3 illustrates a top view of a separable base plate apparatus, system and method in accordance with an embodiment of the present invention.

Referring to FIGS. 2 through 6, the separable base plate 100 is shown in a fully assembled configuration. Referring to FIG. 3, separable base plate 100 may include first and second base portions 110*a*, 110*b*, which each may include first and second track portions, 140*a* and 140*b*, disposed above and rigidly connected to first and second base portions 110*a*, 110*b*. First and second track portions 140*a* and 140*b*, may be configured to receive a carriage unit 170 (not shown) and facilitate knee replacement surgeries.

Figure 4:
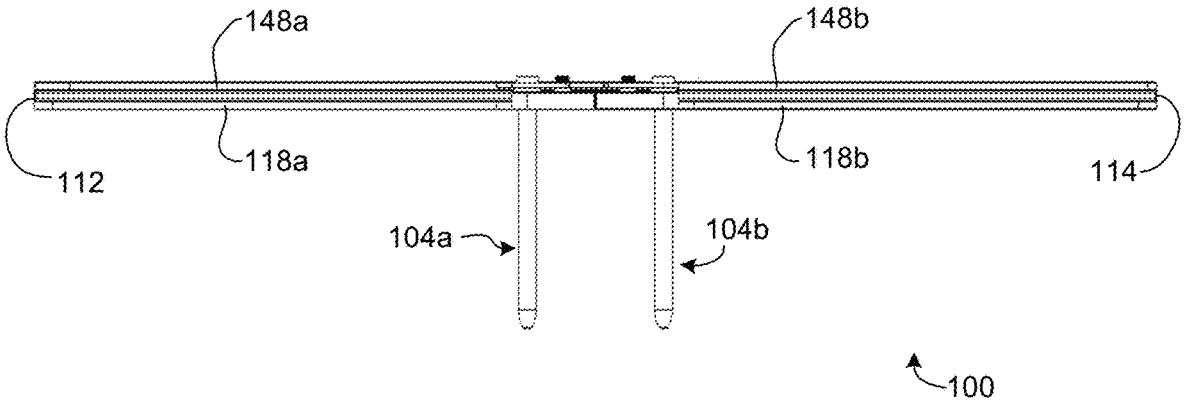
FIG. 4 illustrates a side view of a separable base plate apparatus, system and method in accordance with an embodiment of the present invention.

Referring to FIG. 3, each of the first and second base portions 110*a* and 110*b* may include first and second flat upper base surfaces, 111*a* and 111*b*. Similarly, each of the first and second track portions, 140*a* and 140*b*, may include first and second flat upper track surfaces 141*a* and 141*b*, respectively. A parallel vertical end edge 112 may be common to both 110*a* and 140*a*, while an opposite parallel vertical end edge 114 may be common to both 110*b* and 140*b*. A slide lock 130 may be used to operatively connect first and second base portions 110*a* and 110*b*. Referring to FIG. 4, the first and second drop pin assemblies, 104*a* and 104*b*, may be seen in an assembled configuration, which is configured to drop substantially below first and second base portions 110*a* and 110*b*. Each of the first and second base portions 110*a* and 110*b* may include first and second opposite vertical base edges, 118*a* and 118*b*. Furthermore, each of the first and second track portions, 140*a* and 140*b*, may include first and second opposite vertical lateral edges, 148*a* and 148*b*, respectively.

Figure 5:
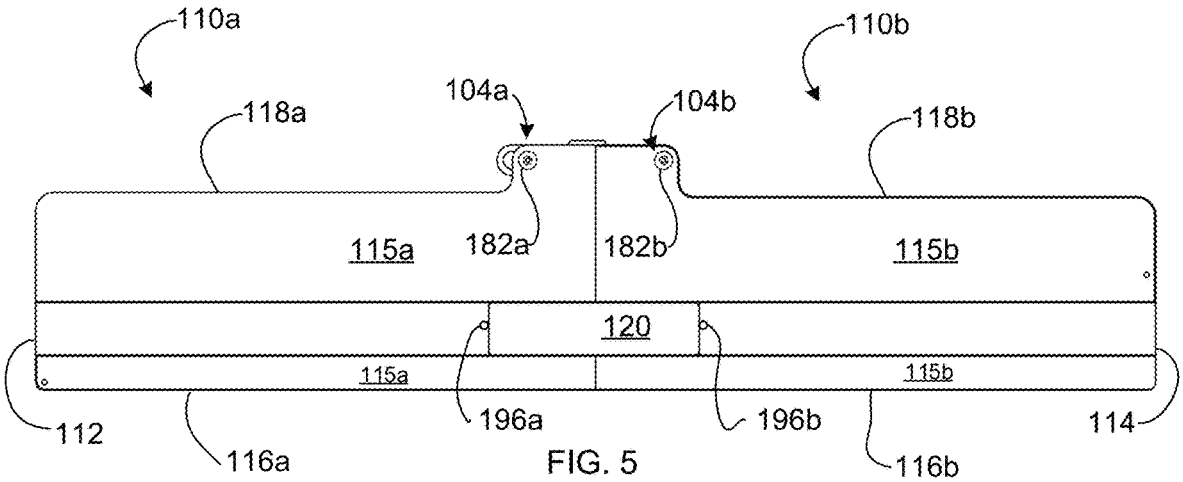
FIG. 5 illustrates a bottom view of a separable base plate apparatus, system and method in accordance with an embodiment of the present invention.

Referring to FIG. 4, each of the first and second base portions 110*a* and 110*b* may include first and second flat bottom surfaces, 115*a* and 115*b*. A first protrusion portion 125 is configured with a pin opening 127 on the first flat vertical lateral edge 118*a* and a second protrusion portion 126 is located on the second flat vertical lateral edge 118*b* also having a pin opening 128. A base plate connector 120 may be included, and in an assembled configuration, base plate connector 120 may operatively connect the first and second base portions 110*a* and 110*b*, in conjunction with the slide lock 130. First and second flat vertical lateral edges 116*a* and 116*b* may define an end along first and second base portions 110*a* and 110*b*. Similarly, another set of first and second flat vertical lateral edges 146*a* and 146*b* may define an end along first and second track portions 140*a* and 140*b*. As shown in FIG. 5, first and second inner vertical lateral edges 142*a* and 142*b* (disposed near one side of track portions 140*a* and 140*b*), and first and second inner vertical lateral edges 144*a* and 144*b* (disposed near the other side of track portions 140*a* and 140*b*) may be utilized to offset the base portions, 110*a* and 110*b*, from the track portions, 140*a* and 140*b*, so that carriage unit 170 may operably connect to the separable base plate assembly 100, and change its position along the track formed therein.

Figure 6:
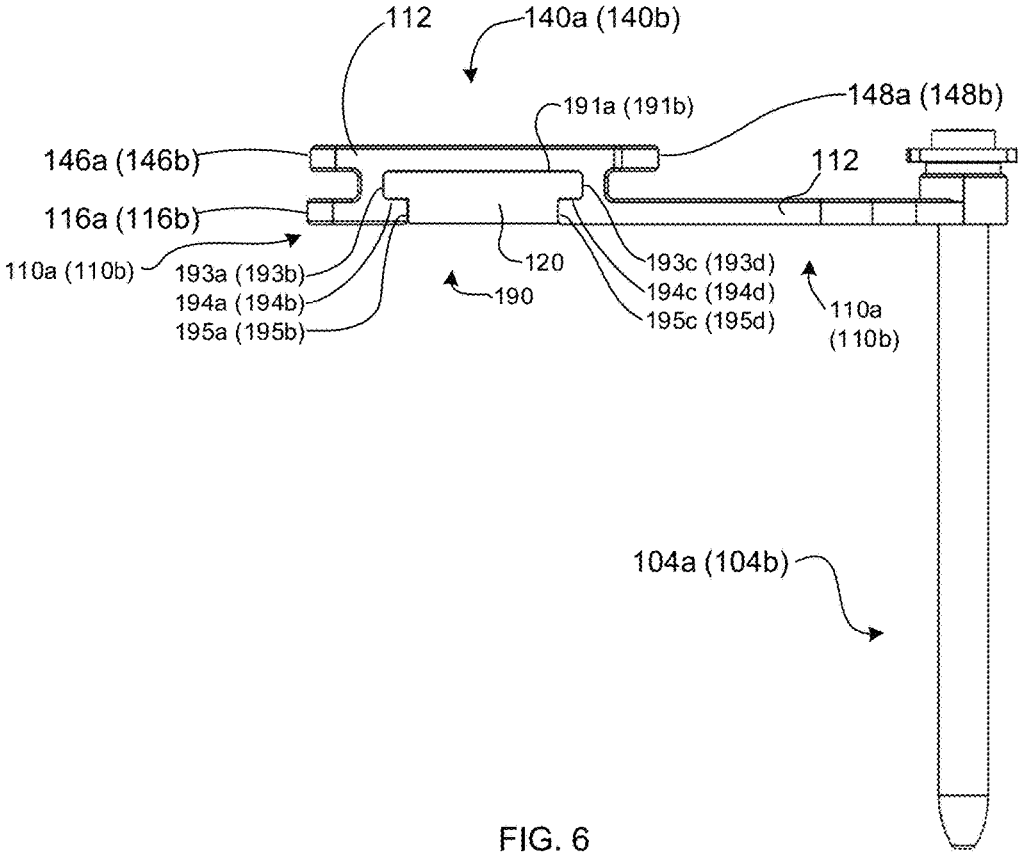
FIG. 6 illustrates another side view of a separable base plate apparatus, system and method in accordance with an embodiment of the present invention.

Referring to FIG. 6, the portions comprising first and second base portions 110*a* and 110*b* and first and second track portions 140*a* and 140*b* may include a cavity assembly 190, within which base plate connector 120 may be inserted. Generally, cavity assembly 190 forms an opening that may extend entirely through separable base plate assembly 100, from parallel vertical end edge 112 through to opposite parallel vertical end edge 114. Alternatively, cavity assembly 190 may extend through a center portion of separable base plate assembly 100, formed within the material offset between parallel vertical end edge 112 and opposite parallel vertical end edge 114, or in any manner suitable to achieve rigid connection of the associated components and overall assembly. Cavity assembly 190 may include inner-cavity surfaces comprising a profile that is substantially configured to receive the complementary shape formed by base plate connector 120, as detailed above. Therefore, cavity assembly 190 may comprise: first and second cavity tops 191*a* and 191*b*; first and second upper vertical cavity surfaces 193*a* and 193*b*; first and second opposite upper vertical cavity surfaces 193*c* and 193*d*; lateral and opposite lateral cavity surfaces 194*a* and 194*b*; first and second opposite lateral cavity surfaces 194*c* and 194*d*; first and second lower vertical cavity surfaces 195*a* and 195*b*; and, first and second opposite lower vertical cavity surfaces 195*c* and 195*d*.

Figure 7A:
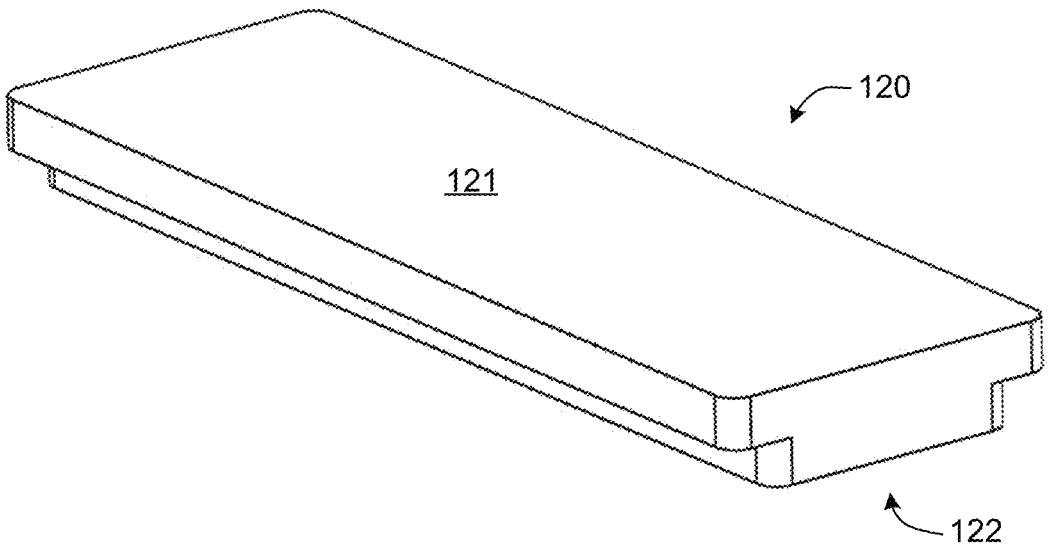
FIG. 7A illustrates a perspective view of a base plate connector, in accordance with an embodiment of the present invention.
Figure 7B:
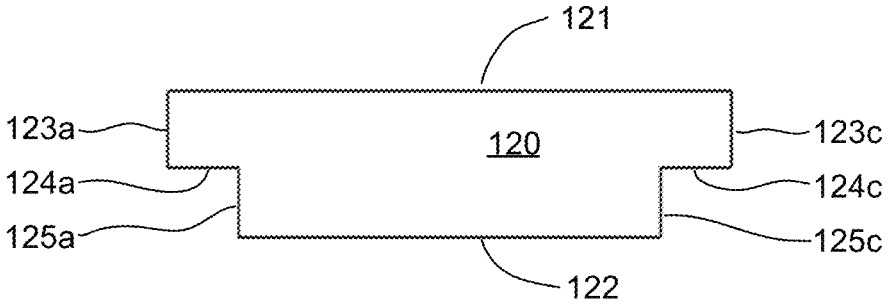
FIG. 7B illustrates a side view of a base plate connector, in accordance with an embodiment of the present invention.

Referring to FIGS. 7A and 7B, in one embodiment, the base plate connector 120 may include an upper connector surface 121, a lower connector surface 122, an upper vertical connector surface 123*a*, and an opposite upper vertical connector surface 123*c*. Base place connector 120 may further include a lateral connector surface 124*a*, an opposite lateral connector surface 124*c*, and may also include a lower vertical connector surface 125*a* and an opposite lower vertical connector surface 125*c*. In operation, the base plate connector 120 forms a linearly-extruded shape formed from a T-shaped cross-section, which facilitates the joining of respective first and second base portions, 110*a* and 110*b*, within a bottom-facing track (as substantially represented in FIG. 5). Base plate connector 120 may be operably connected within the bottom-facing track formed within first and second flat lower base surfaces 115*a* and 115*b* by use of a stop, or a protrusion, or by any other means that stops travel of the base plate connector 120 within the track to allow for continued coupling of the device. Importantly, the base plate connector 120 may take the form of any cross-sectional shape, adapted for the purpose of joining and/or rigidly coupling respective first and second base portions 110*a* and 110*b*. For example, base plate connector 120 may have a cross-sectional shape in the form of a dovetail joint, a cylindrical extrusion, or one or more L-shaped extrusions. Similarly, the receiving portion of the baseplate connector 120—the bottom-facing track formed within first and second flat lower base surfaces 115*a* and 115*b*—may be formed in a complementary fashion to receive these alternative cross-sectional shapes.

Figure 8A:
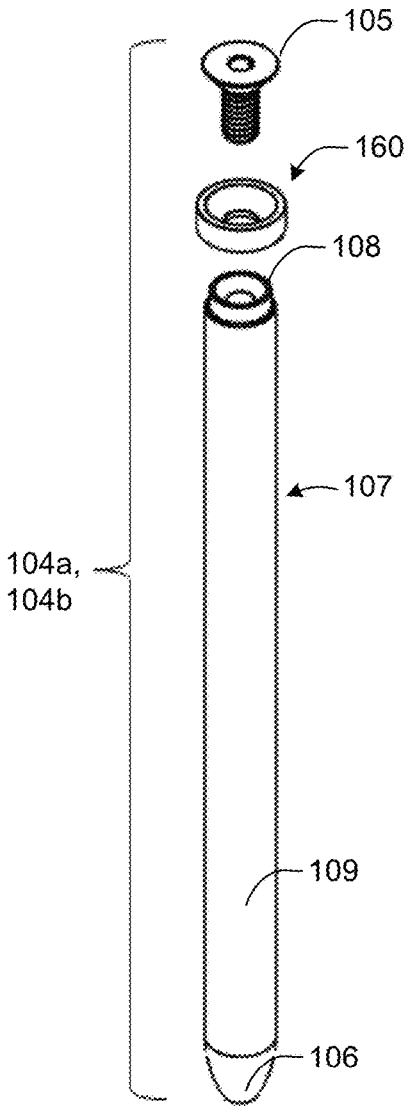
FIG. 8A illustrates an exploded perspective view of a drop pin assembly, in accordance with an embodiment of the present invention.
Figure 8B:
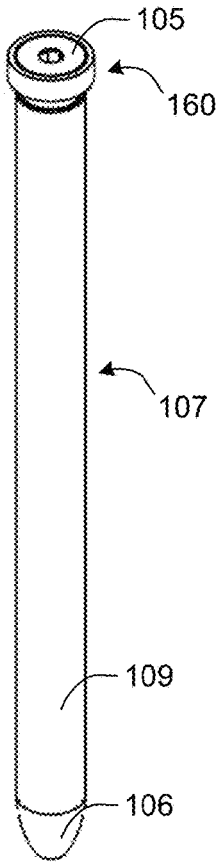
FIG. 8B illustrates a perspective view of a drop pin assembly, in accordance with an embodiment of the present invention.
Figure 8C:
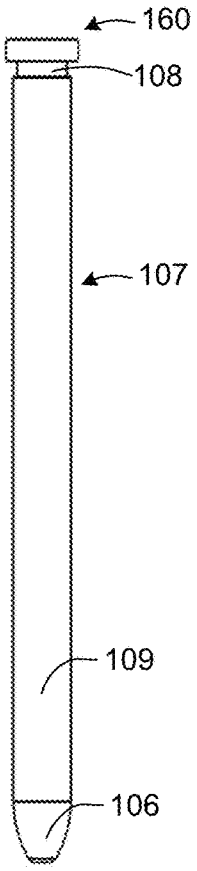
FIG. 8C illustrates a side view of a drop pin assembly, in accordance with an embodiment of the present invention.
Figure 9A:
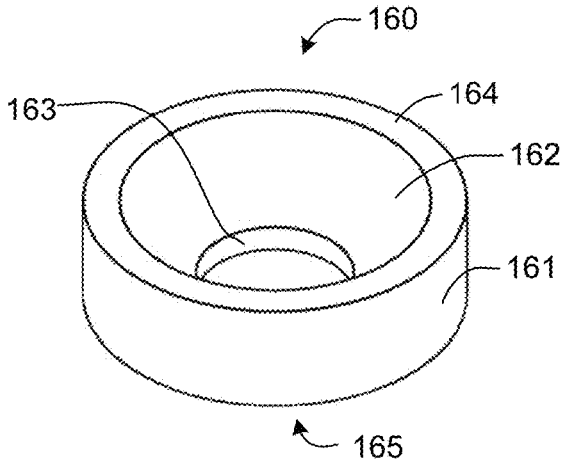
FIG. 9A illustrates a perspective view of a stop head, in accordance with an embodiment of the present invention.
Figure 9B:
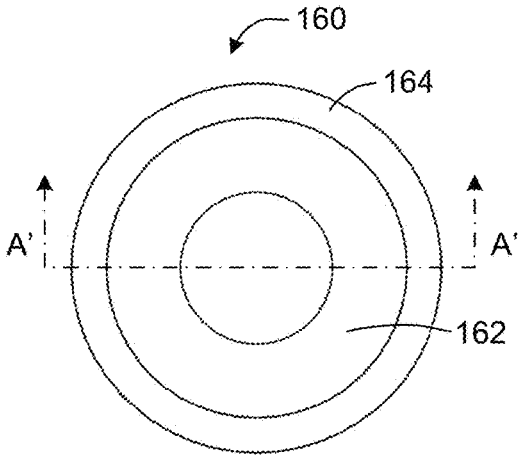
FIG. 9B illustrates a top view of a stop head, in accordance with an embodiment of the present invention.
Figure 9C:
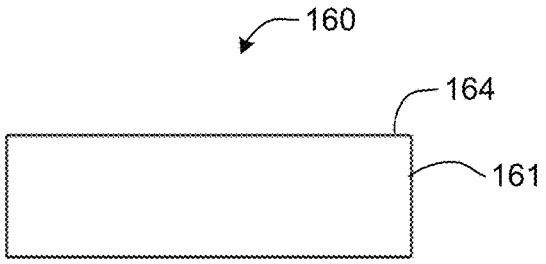
FIG. 9C illustrates a side view of a stop head, in accordance with an embodiment of the present invention.
Figure 9D:
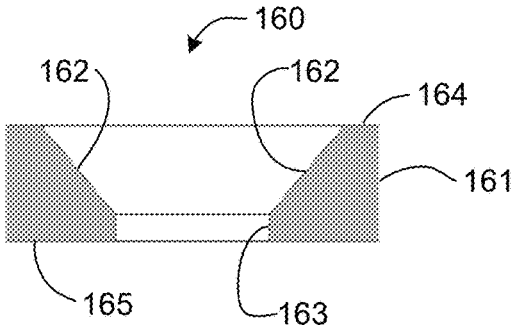
FIG. 9D illustrates a section view of a stop head, taken along the section A'-A' shown in FIG. 9B, in accordance with an embodiment of the present invention.

FIGS. 8A-8C detail an embodiment of the first and second drop pin assemblies, 104*a* and 104*b*, respectively, each of which may include a bolt 105 (designated as first and second bolts 105*a*, 105*b*), a stop head 160, and a drop pin 107, comprising an upper drop pin portion 108 and a lower drop pin portion 109. Lower drop pin portion 109 may be configured with a bullet-point end 106, to facilitate assembly of the first and second drop pin assemblies, 104*a* and 104*b*, in relation to separable base plate assembly 100.

FIGS. 9A-9D detail an embodiment of the stop head 160, which may include a top 164, a bottom 165, and a cylindrical outer surface 161. Stop head 160 may further include a tapered inner surface 162 disposed adjacent to a cylindrical inner surface 163, both of which form the opening extending from the top 164 through to the bottom 165. In operation, the tapered inner surface 162 may be configured to receive the head of the bolt 105, in which the bolt 105 then threads into the body of drop pin 107. The gap substantially formed by upper drop pin portion 108 becomes apparent by affixing the upper and lower drop pin portions 108 and 109 to stop head 160, as shown in FIGS. 8A to 8C.

Figure 10A:
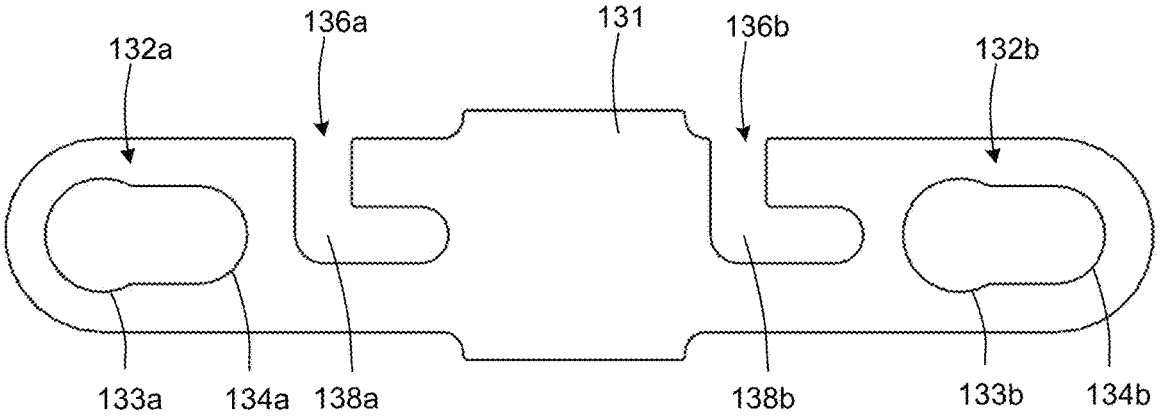
FIG. 10A illustrates a top view of a slide lock, in accordance with an embodiment of the present invention.
Figure 10B:
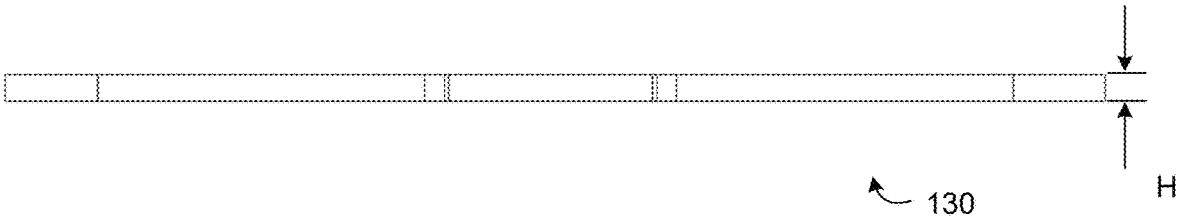
FIG. 10B illustrates a side view of a slide lock, in accordance with an embodiment of the present invention.

Turning now to FIGS. 10A and 10B, the slide lock 130 may include a body portion 131 that may further include a pin receiver assembly 132*a* and an opposite pin receiver assembly 132*b*, and an L-shaped nut receiver assembly 136*a* and an opposite L-shaped nut receiver assembly 136*b*. Pin and opposite pin receiver assembly 132*a* and 132*b* may include a first and second opening 133*a* and 133*b*, and may also include a first and second opposite opening 134*a* and 134*b*, also as shown in FIG. 10A. L-shaped and opposite L-shaped nut receiver assemblies 136*a* and 136*b* may further include a first and second mid-portion 138*a* and 138*b*. First and second openings, 133*a* and 133*b*, may be configured to receive a diameter substantially equivalent to that of the lower drop pin portion 109, while the first and second opposite openings 134*a* and 134*b* may be configured to receive another diameter substantially equivalent to that of the upper drop pin portion 108. In a side view represented in FIG. 10B, slide lock 130 may have a height, represented by element H.

Lastly, in a side view represented in FIG. 10B, slide lock 130 may include a uniform height, represented element H, which may be configured to allow for portions of the body 131 surrounding pin receivers 132*a* and 132*b* to fit within the vertical gap formed by upper drop pin portion 108 as shown in FIG. 8C. Similarly, H allows nut receivers 136*a* and 136*b* to receive bolts 105*a* and 105*b*, as will be described in reference to FIG. 13.

Figure 13:
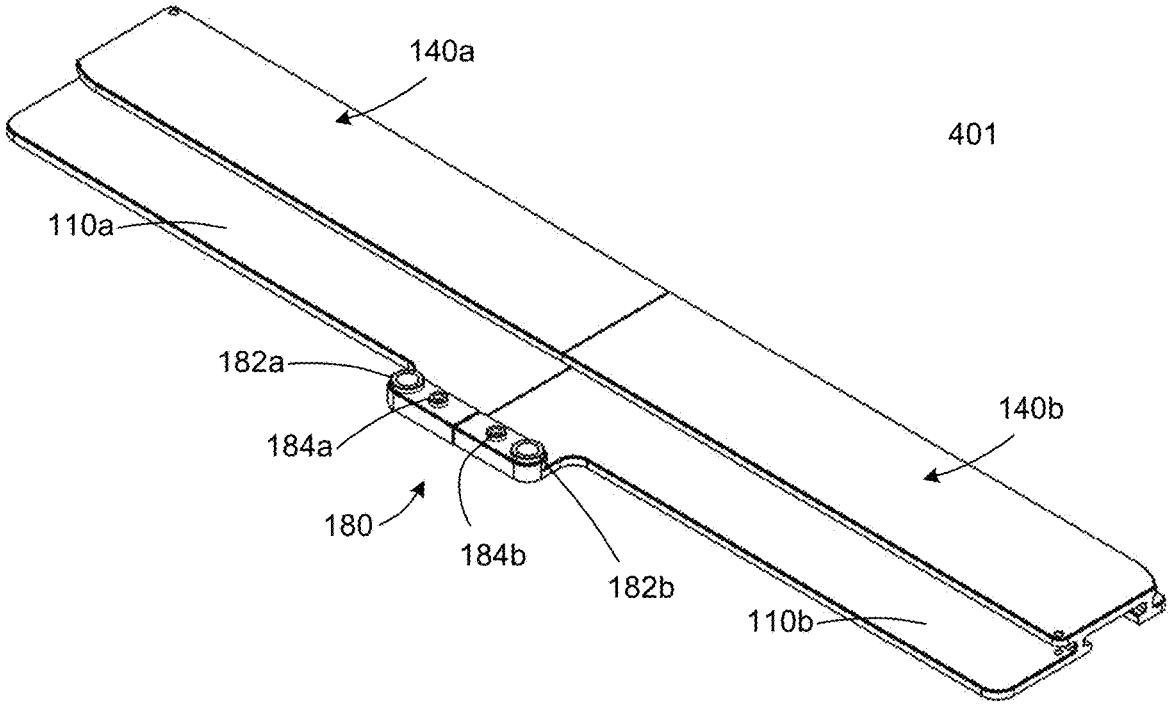

Referring to FIG. 13, a projection assembly 180 may be included, which may be disposed on first and second flat upper surfaces 111*a* and 111*b* of first and second base portions 110*a* and 110*b*, which may further form openings extending fully through to first and second flat lower base surfaces 115*a* and 115*b*. The portion of projection assembly 180 that extends over the first base portion 110*a* may include a first pin flange 182*a* and a first bolt flange 184*a*. Similarly, the portion of projection assembly 180 that extends over the second base portion, 110*b*, may include a second pin flange 182*b* and a second bolt flange 184*b*. With reference to FIGS. 1-2, 4, 6, and 13, each of the first and second pin flanges 182*a* and 182*b* form openings that extends through bottom surfaces 115*a* and 115*b* of first and second base portions 110*a* and 110*b*, which allows first and second drop pin assemblies, 104*a* and 104*b*, to extend below the bottom surfaces 115*a* and 115*b* for further assembly separable base plate assembly 100, and for further coupling to clamp assembly 150.

Figure 11:
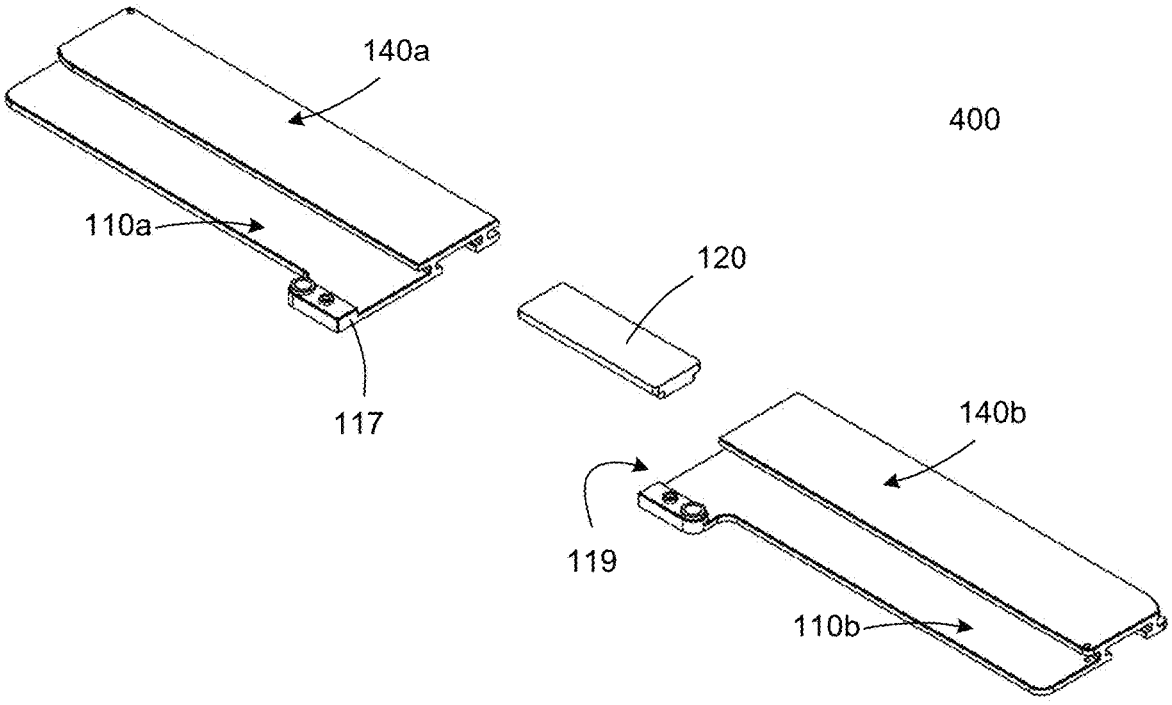
FIG. 11 illustrates a first step showing the alignment of certain components, according to a method of assembling an embodiment of the invention.

Referring to FIGS. 11 through 20, a method of assembling the separable base plate assembly 100 is described. At a first step 400, as shown in FIG. 11, the components comprising first and second base portions 110*a* and 110*b* and first and second track portions 140*a* and 140*b*, may be provided, along with the base plate connector 120. The portion comprising first base portion 110*a* is shown to have first middle vertical surface 117; the portion comprising second base portion 110*b* is shown to have second middle vertical surface 119. Step 400 may include aligning the portions comprising first and second base portions, 110*a* and 110*b*, so that first and second middle vertical surfaces 117 and 119 face each other, and so that base plate connector 120 substantially aligns with the bottom-facing track formed within first and second flat bottom surface 115*a* and 115*b*, represented as the cavity assembly 190 as shown in FIG. 6.

Figure 12:
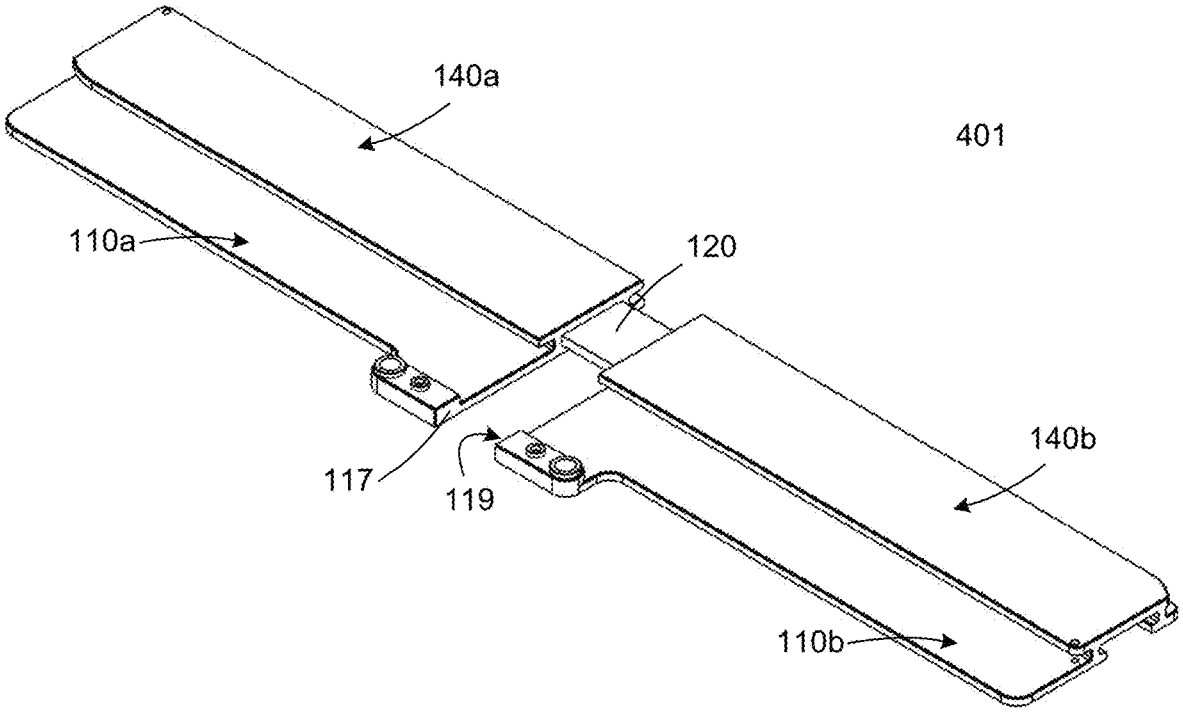
FIGS. 12 and 13 illustrate a second step showing coupling of certain components, according to a method of assembling an embodiment of the invention.

At a second step 401, and as shown in FIGS. 12 and 13, the portions forming first and second base portions 110*a* and 110*b* are urged together, with the base plate connector 120 operatively connecting the same. Step 401 may further include stopping the base plate connector 120 from movement within the bottom-facing track, represented as cavity assembly 190, formed within first and second flat bottom surfaces 115*a* and 115*b* by any means that stops travel of the base plate connector 120 within the track which allows for continued coupling of the device, such as first and second set screws 196*a* and 196*b*, as shown in FIG. 5.

Figure 14:
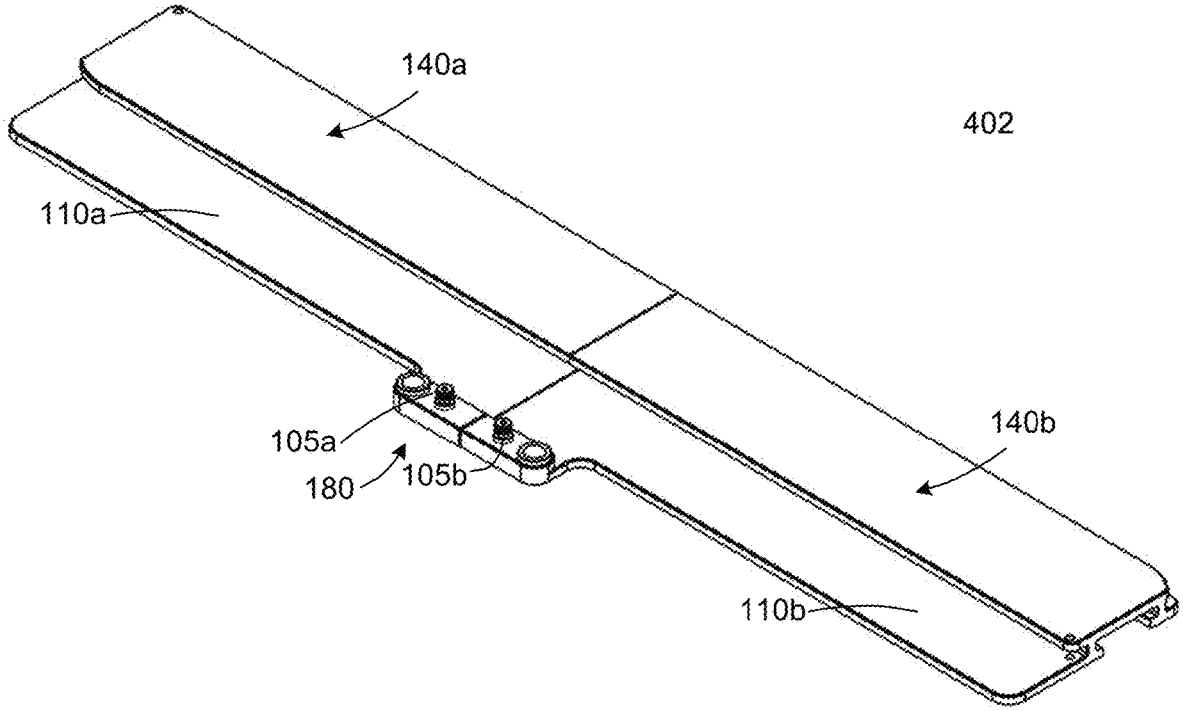
FIGS. 14-16 illustrate a third step showing coupling of a slide lock to certain components, according to a method of assembling an embodiment of the invention.
Figure 15:
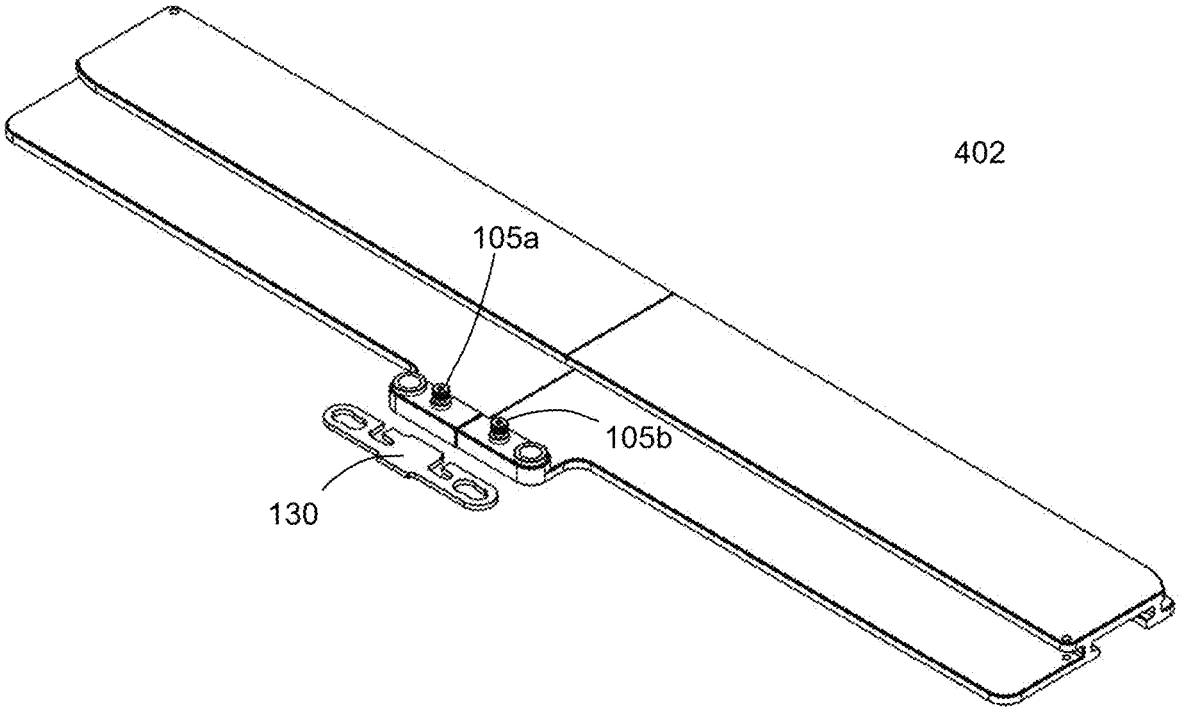
Figure 16:
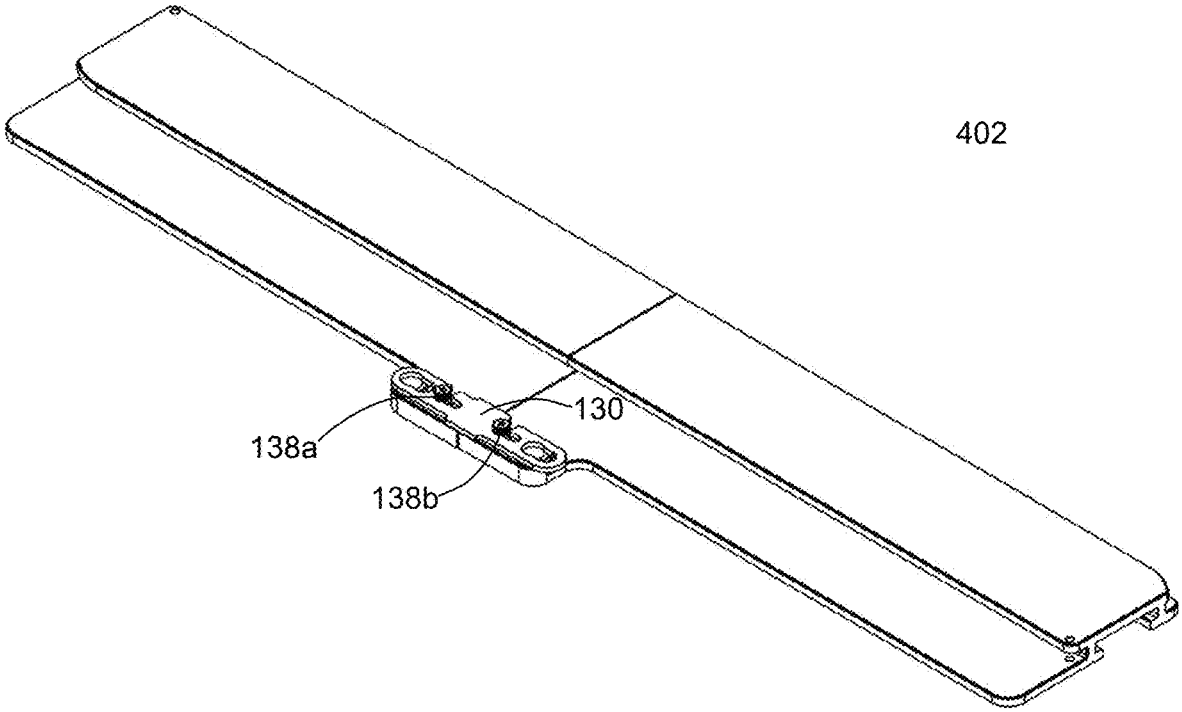

Referring to FIG. 14-16, in a third step 402, slide lock 130 may be provided, and first and second bolts 105*a* and 105*b* may be partially installed within threaded openings formed at first and second bolt flanges, 184*a* and 184*b*, respectively. As further shown in FIG. 16, and with reference to FIGS. 10A-10B, 21A, and 21B, slide lock 130 may be positioned as shown, so that bolts 105*a* and 105*b* are positioned at mid-portions of the L-shaped and opposite L-shaped nut receivers 136*a* and 136*b*, designated as first and second mid-portions 138*a* and 138*b*.

Figure 17:
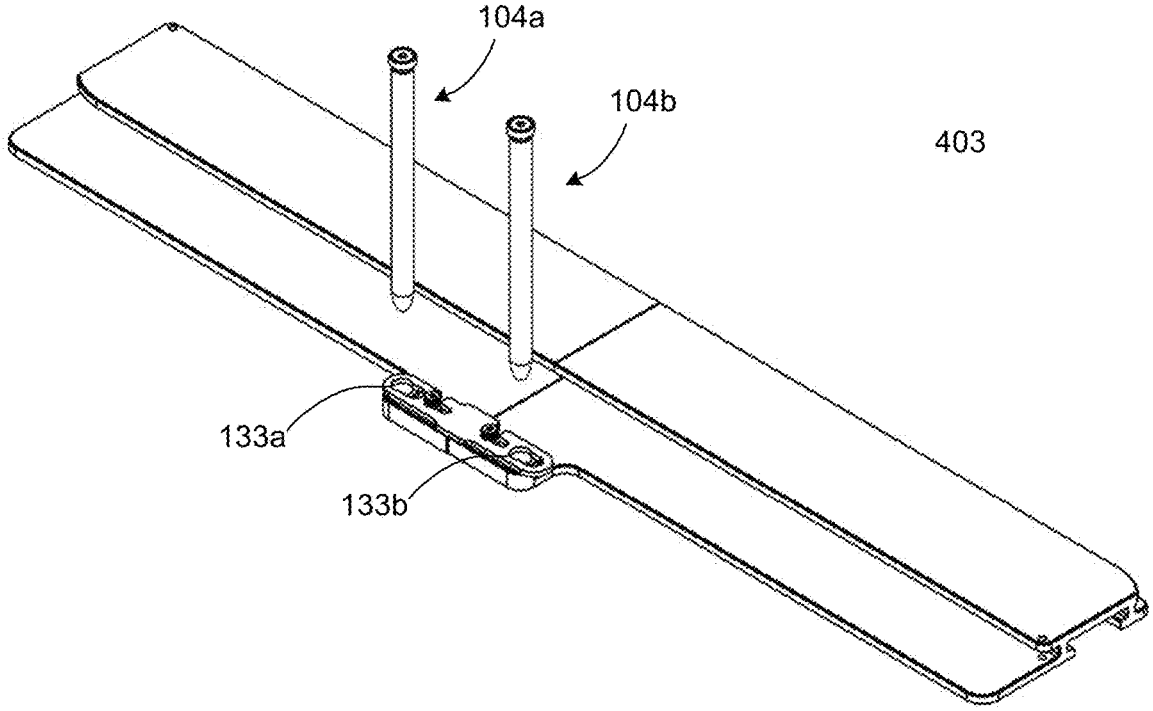
FIGS. 17-19 illustrate a fourth step showing coupling of drop pin assemblies to certain components, according to a method of assembling an embodiment of the invention.
Figure 18:
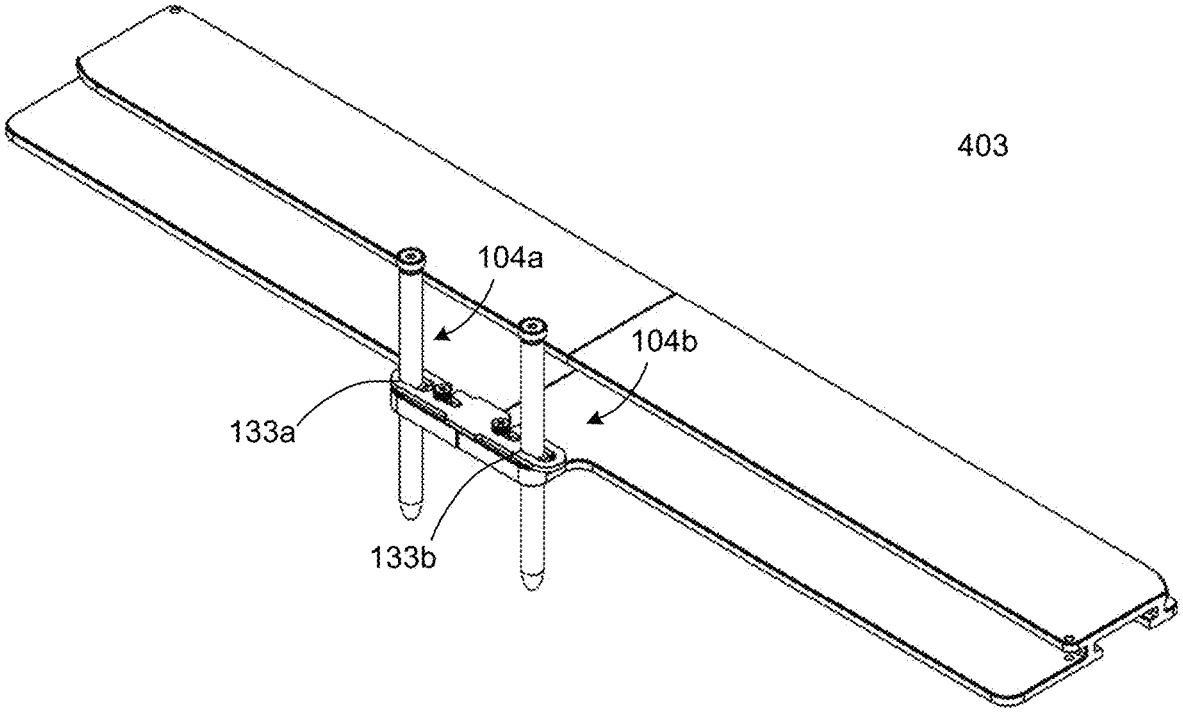
Figure 19:
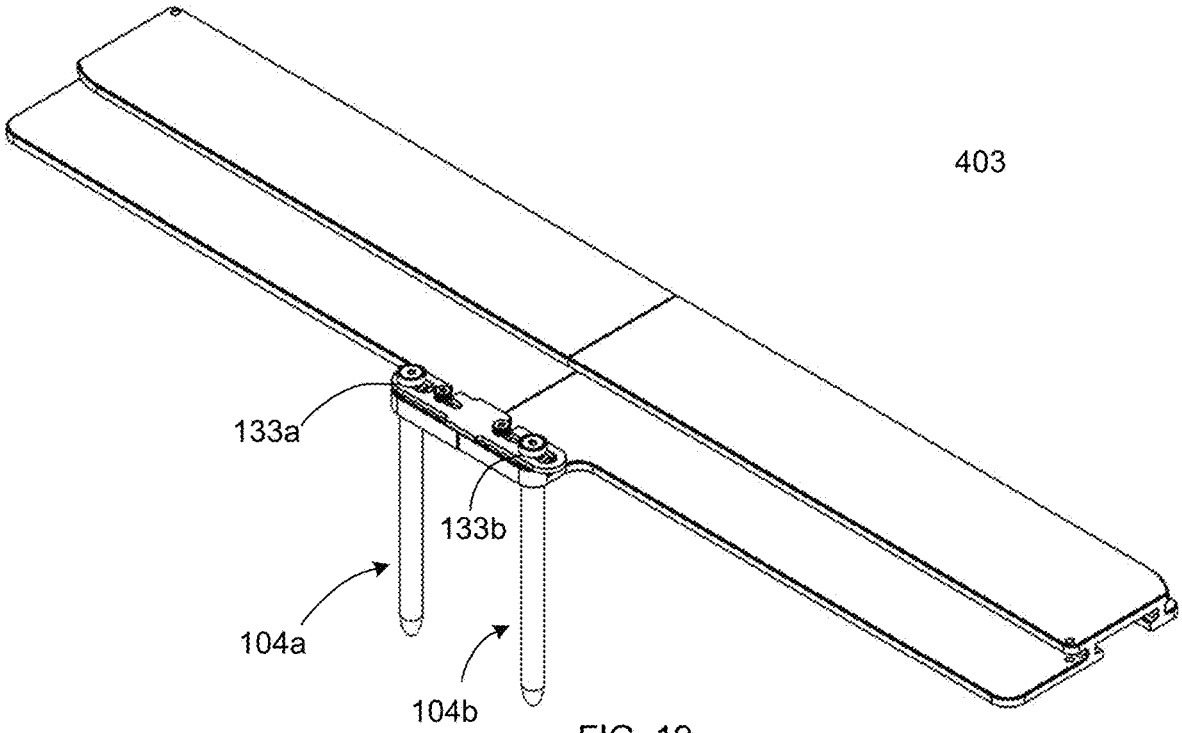

Referring now to FIG. 17-19, first and second drop pin assemblies 104*a* and 104*b* may be provided, in a fourth step, 403. In specific reference to FIGS. 17-19, and 21A, the first and second openings, 133*a* and 133*b*, allow for sufficient space such that lower drop pin portion 109 may fit through the opening, so that the bottom 165 of stop head 160 may rest on body portion 131 of slide lock 130. FIG. 19 specifically shows how first and second drop pin assemblies 104*a* and 104*b* are to be configured in a dropped position.

Figure 20:
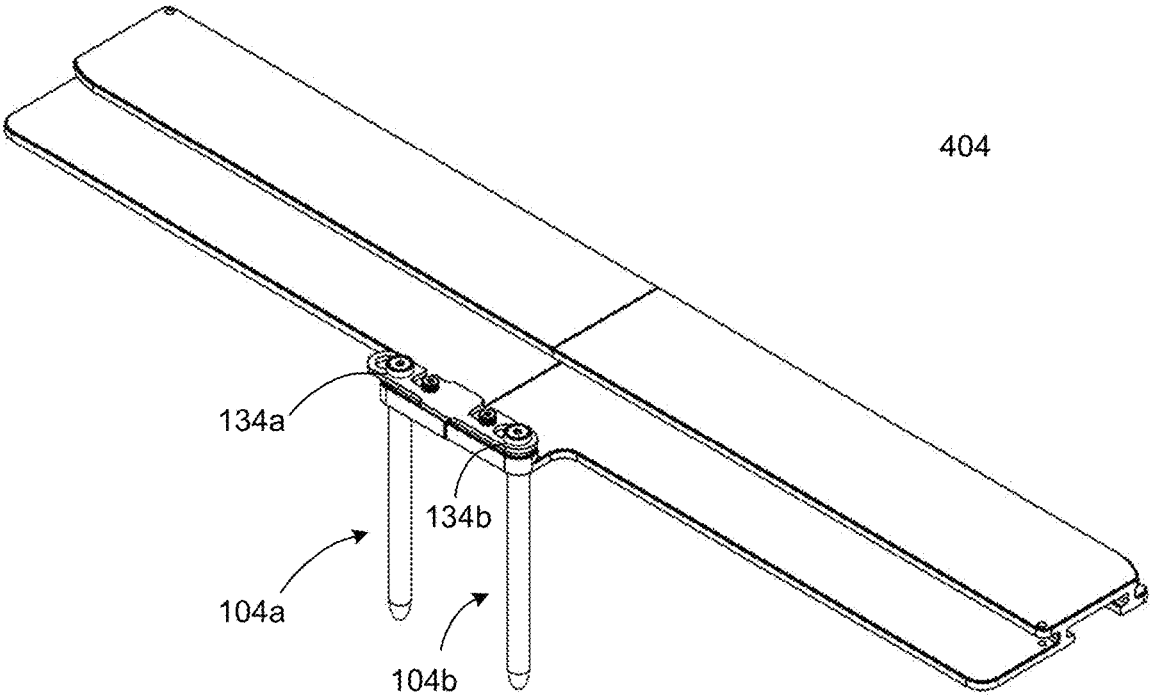
FIG. 20 illustrates a fifth step showing coupling of a slide lock to certain components, according to a method of assembling an embodiment of the invention.
Figure 21A:
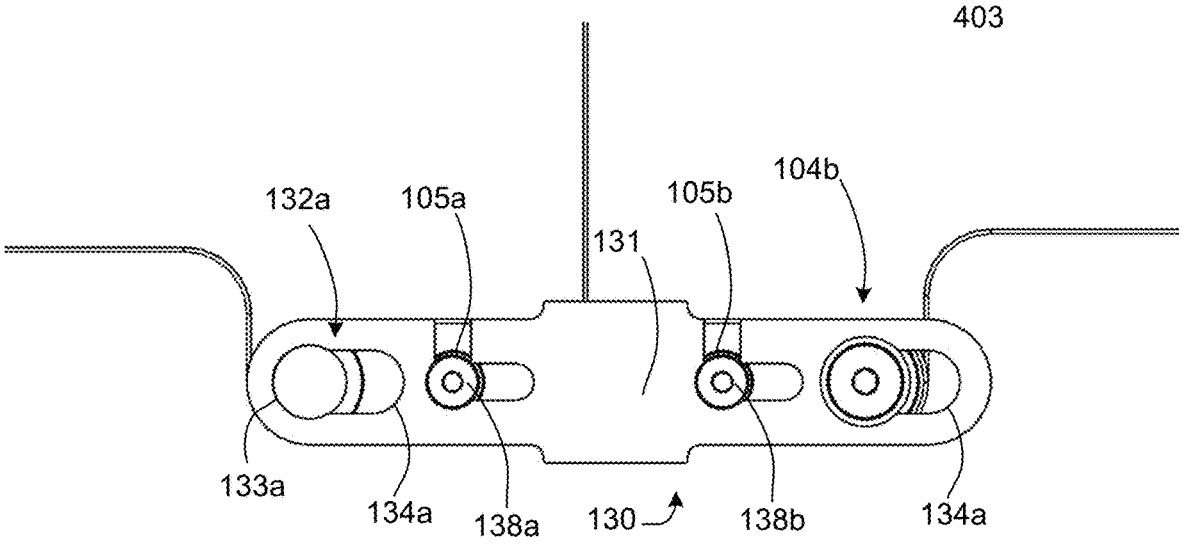
FIGS. 21A and 21B illustrate certain coupling features of a slide lock and associated components, according to a method of assembling an embodiment of the invention.
Figure 21B:
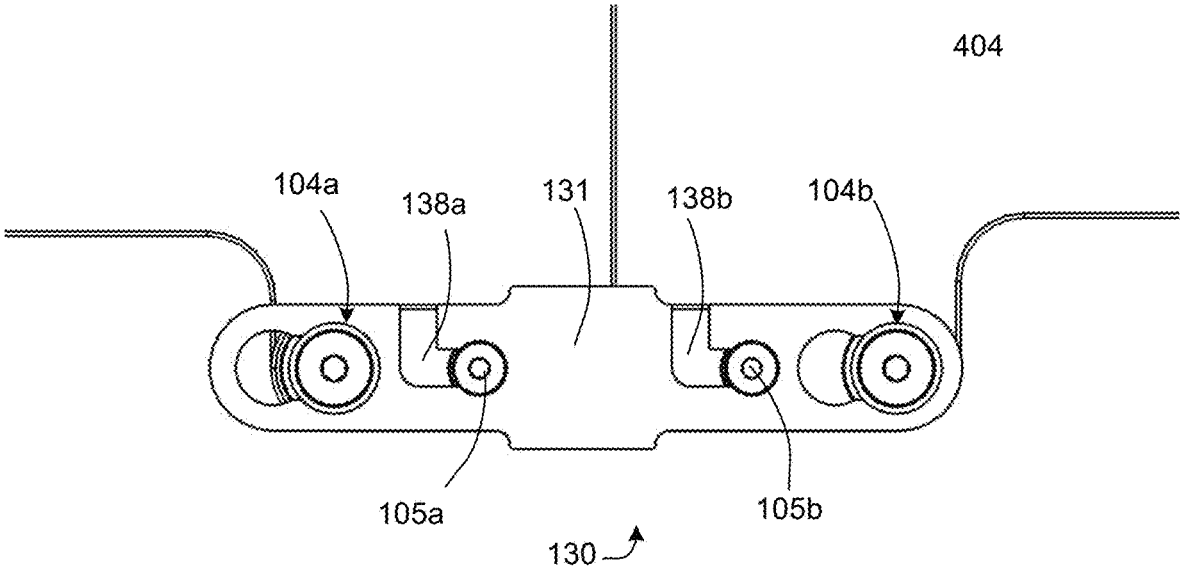
Figure 22:
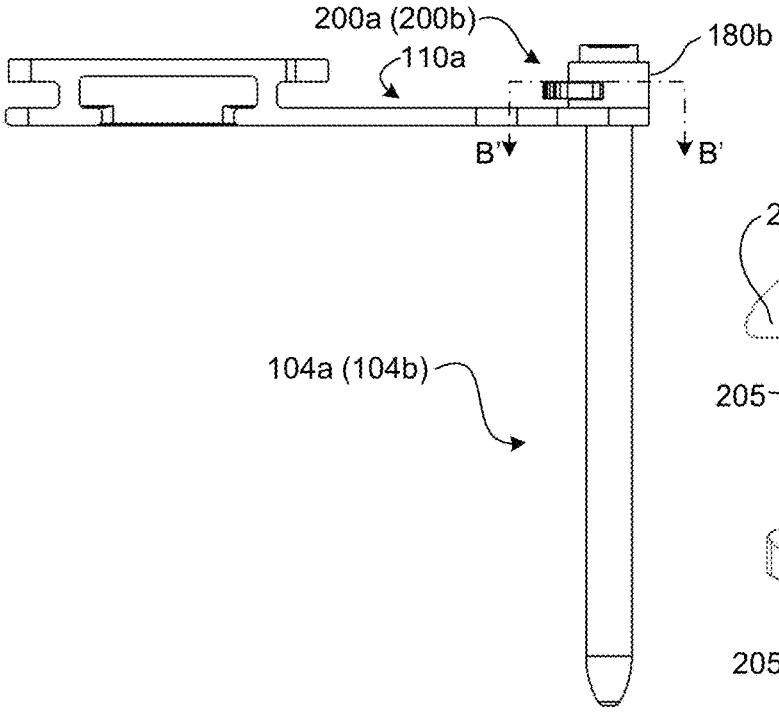
FIG. 22 illustrates a side view of a separable base plate apparatus, system and method in accordance with an alternative embodiment of the present invention.

Referring to FIG. 20 (also substantially represented in FIG. 1), and 21B, the slide lock may be translated in a fifth step, 404, which engages first and second opposite openings, 134*a* and 134*b*, to operatively couple to the upper pin portion(s) 108 of first and second drop pin assemblies 104*a*, 104*b*. In this way, the drop pin assemblies 104*a*, 104*b*, are operably coupled within their respective openings, 134*a* and 134*b*, ensuring that first and second base portions 110*a* and 110*b* remain coupled.

Figure 23:
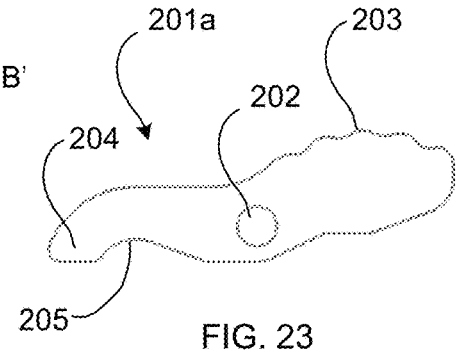
FIG. 23 illustrates a top view of a latch, according to an alternative embodiment of the invention.
Figure 24:
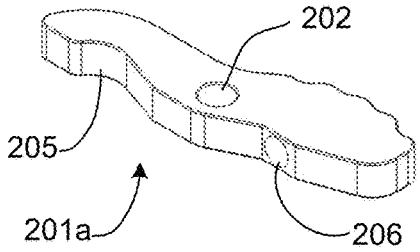
FIG. 24 illustrates a perspective view of a latch, according to an alternative embodiment of the invention.
Figure 25:
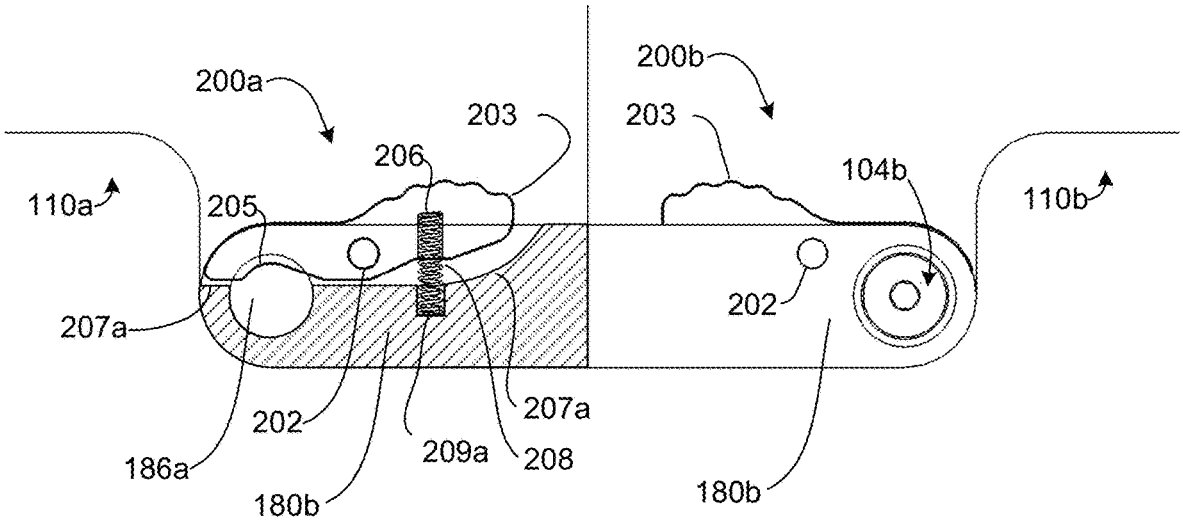
FIG. 25 illustrates a partial sectional, top view of a spring-loaded lock assembly, taken along section B'-B' of FIG. 22, according to an alternative embodiment of the invention.
Figure 26:
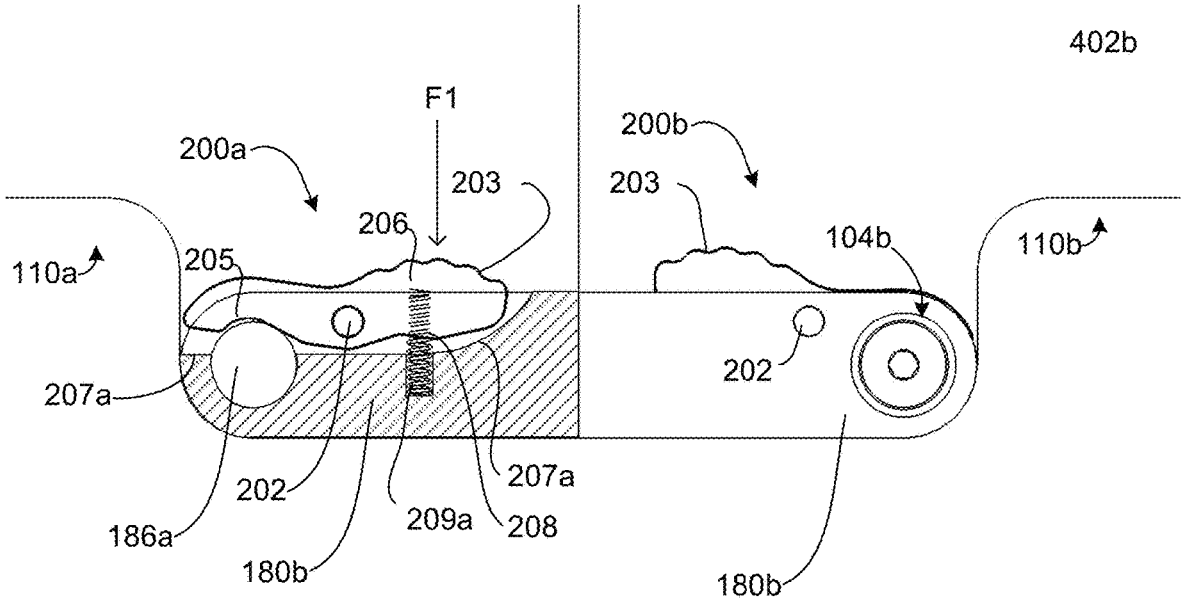
FIG. 26 illustrates a third step showing coupling of a spring-loaded lock assembly, according to an alternative embodiment of the invention.
Figure 27:
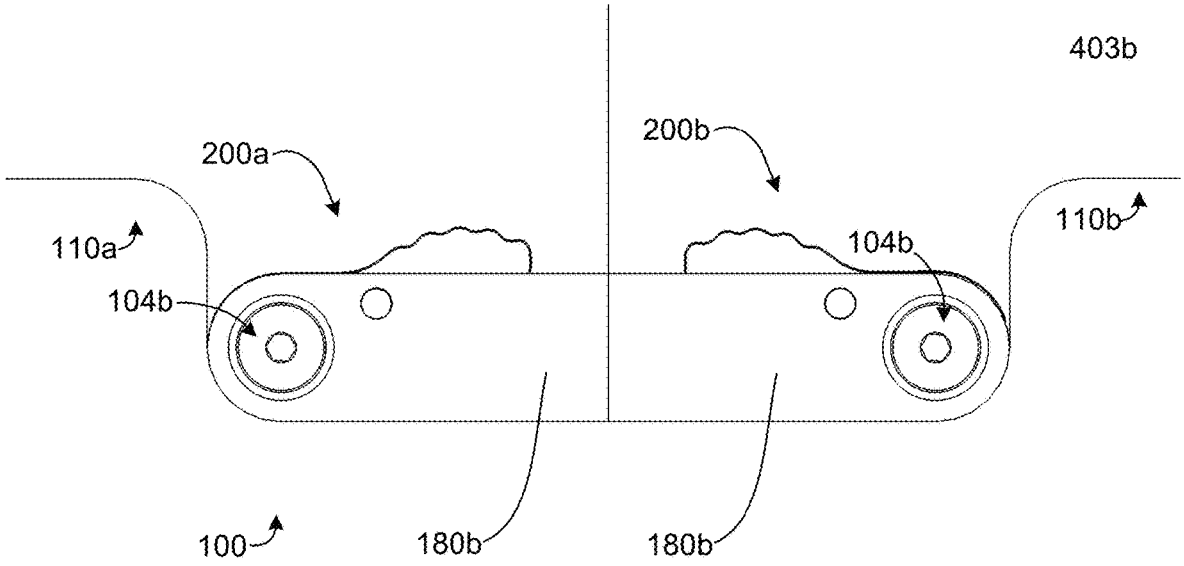
FIG. 27 illustrates a fourth step showing coupling of a spring-loaded lock assembly, according to an alternative embodiment of the invention.
Figure 28:
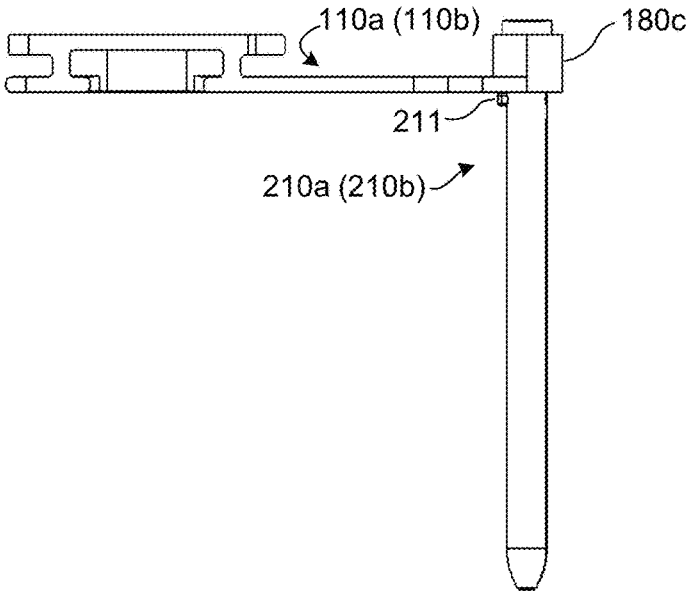
FIG. 28 illustrates a side view of a separable base plate apparatus, system and method in accordance with an alternative embodiment of the present invention.

Referring to FIGS. 22-27, in an alternative embodiment, first and second spring-loaded lock assemblies, 200*a* and 200*b* respectively, are described. First spring-loaded lock assembly 200*a* comprises a first latch 201*a* and spring 208, while second spring-loaded lock assembly 200*b* comprises a second latch 201*b* and spring 208. As best seen in FIGS. 23 and 24, first latch 201*a* may include a pivot portion 202, an engagement portion 203, a latch portion 204 having an arcuate surface 205, and a spring receiver portion 206. Second spring-loaded lock assembly 200*b* may include a similar arrangement of components, albeit in a mirrored fashion to that of first spring-loaded assembly 201*a* shown in FIGS. 23 and 24. In operation, first spring-loaded lock assembly 200*a* is configured to couple to a spring-loaded projection assembly 180*b* at a first recessed portion 207*a*, such that first latch 201*a* may be pivoted about pivot portion 202. The location and general shape of the first recessed portion 207*a* is evidenced from Section B'-B' taken in FIG. 22 through the first base portion 110*a*. Section B'-B' is shown in FIGS. 25 and 26. Spring 208 couples to a first spring abutment 209*a* of first recessed portion 207*a*. As shown in FIG. 26, when acted upon by force F1, first latch 201*a* pivots about pivot portion 202, compressing spring 208 and exposing a first bolt opening 186*a* in its entirety, such that first drop pin assembly 104*a* may pass through during the assembly of separable base plate assembly 100. Second drop pin assembly 104*b* may be installed in a similar manner (not shown). This results in the positioning of second drop pin assembly 104*b* as substantially shown in FIGS. 25 and 26, achieved by exerting a force F2 on the engagement portion 203 of second latch 201*b*, such that second latch 201*b* coupled to a second recessed portion 207*b* pivots about pivot portion 202 while compressing spring 208 contained within a second spring abutment 209*b* (not shown). This exposes a second bolt opening 186*b* in its entirety, such that second drop pin assembly 104*b* may pass through during the assembly of separable base plate assembly 100, as shown in FIGS. 25 and 26. Once fully inserted, upper drop pin portion 108 of each of the first and second drop pin assemblies 104*a* and 104*b* engages with the arcuate surface 205 of each of the first and second latches 201*a* and 201*b*, respectively, due to the reactionary forces of each spring 208. In this manner, first and second drop pin assemblies 104*a* and 104*b* may be rigidly connected to the separable base plate assembly 100, as shown in FIG. 27.

The method of assembling the separable base plate assembly 100 may be conducted substantially similar to the previously described first and second steps 400 and 401 as shown in FIGS. 11-13. However, in this alternative embodiment in a third step 402*b*, first and second latches are pushed in the direction represented as F1 of FIG. 26 and F2 (not shown), to an extent which allows first and second drop pin assemblies 104*a* and 104*b* to pass through first and second bolt openings 186*a* and 186*b*, respectively. In the third step 402*b*, first and second drop pin assemblies 104*a* and 104*b* are fully inserted. Then, in a fourth step 403*b*, first and second latches are released, as shown in FIG. 27. In the fourth step 403*b*, the upper drop pin portion 108 of each of the first and second drop pin assemblies 104*a* and 104*b* engages with the arcuate surface 205 of each of the first and second latches 201*a* and 201*b*, respectively, due to the reactionary forces of each spring 208. In this way, the method of assembly with respect to this alternative embodiment similarly results in first and second drop pin assemblies 104*a* and 104*b* being rigidly connected to the separable base plate assembly 100 (as shown in FIG. 27).

Referring to FIGS. 28-33, according to an alternative embodiment, first and second turn pin lock assemblies, 210*a* and 210*b*, are described. In this embodiment, with reference to FIG. 29, first and second base portions comprise a turn pin assembly 180*c*. The portion of the turn pin assembly 180*c* that extends over the first base portion 110*a*, may include a first turn pin opening 216*a* and a first slotted spring pin opening 218*a*. Similarly, the portion of the turn pin assembly 180*c* that extends over the second base portion 110*b*, may include a second turn pin opening 216*b* and a second slotted spring pin opening 218*b*. First and second turn pin openings 216*a* and 216*b*, and first and second slotted spring pin openings 218*a* and 218*b* extend through turn pin projection assemblies 180*c*, as well as through first and second base portions 110*a* and 110*b* so that first and second turn pin lock assemblies 210*a* and 210*b* may pass therethrough.

Figure 30A:
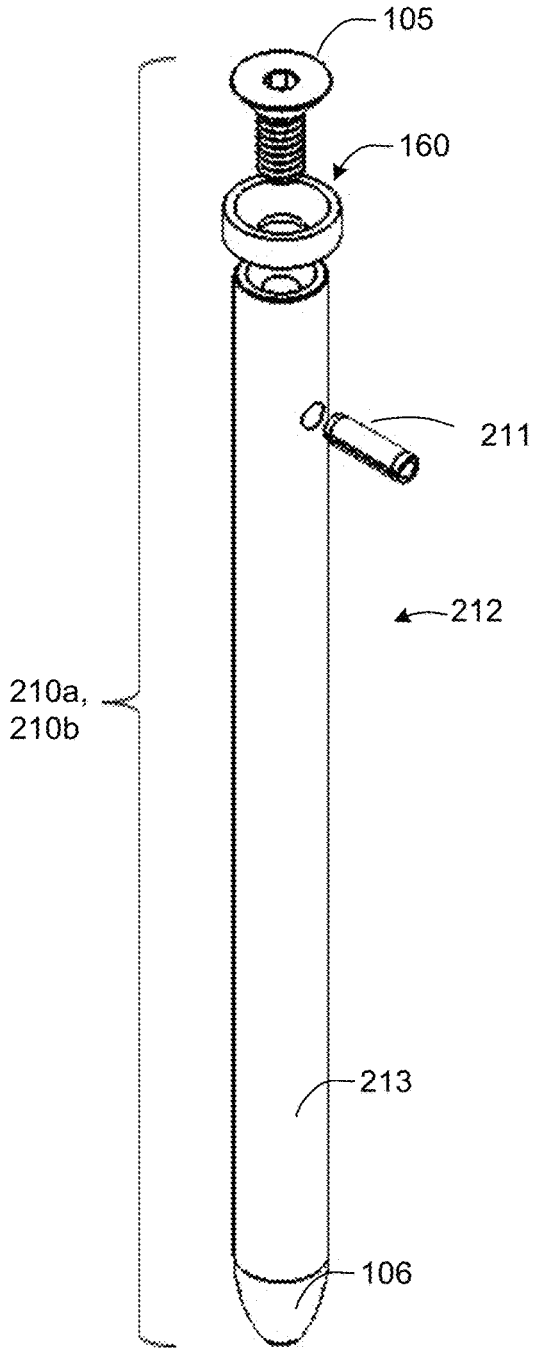
FIG. 30A illustrates an exploded, perspective view of a turn pin lock assembly, according to an alternative embodiment of the invention.
Figure 30B:
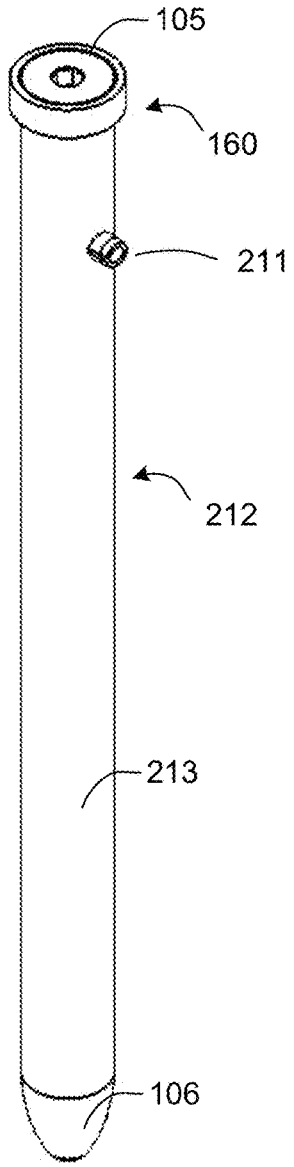
FIG. 30B illustrates a perspective view of a turn pin lock assembly, according to an alternative embodiment of the invention.
Figure 30C:
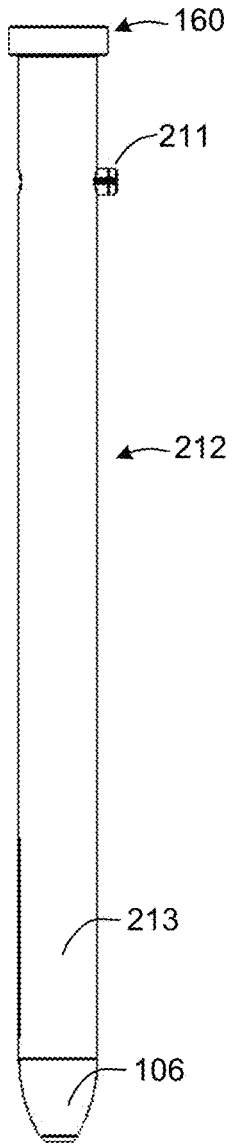
FIG. 30C illustrates a side view of a turn pin lock assembly, according to an alternative embodiment of the invention.
Figure 31:
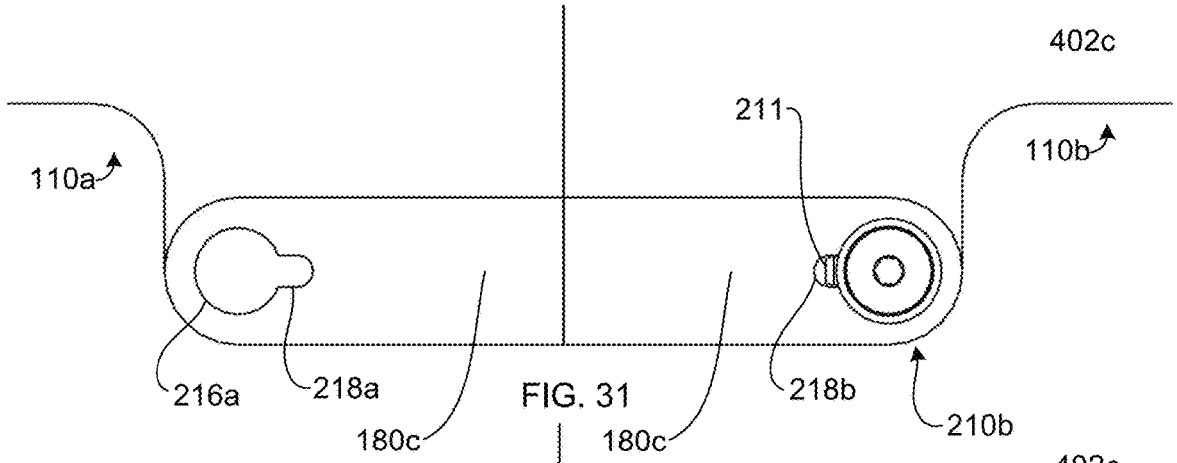
FIGS. 31 and 32 illustrate a third step showing coupling of turn pin lock assemblies to associated components, according to an alternative embodiment of the invention.
Figure 32:
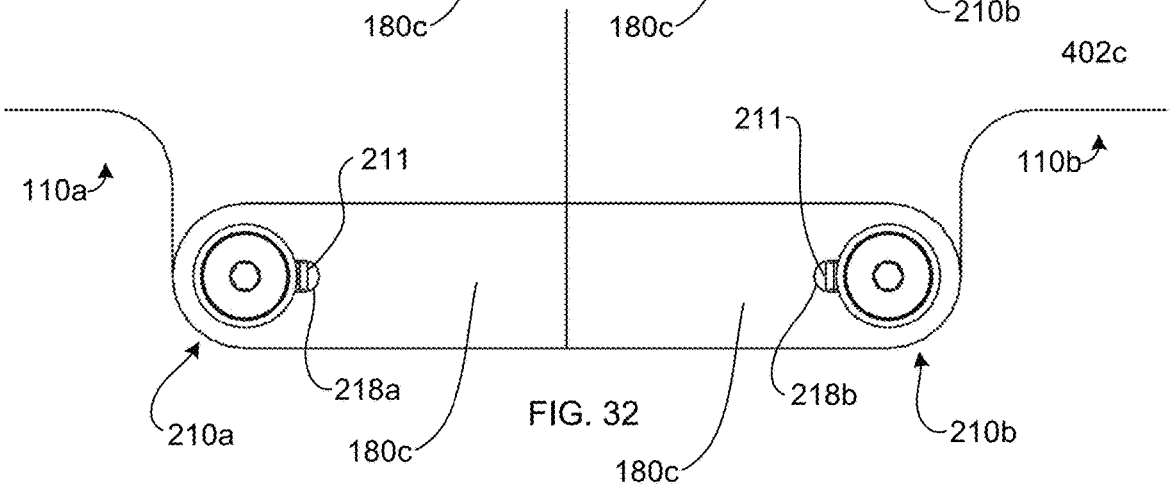
Figure 33:
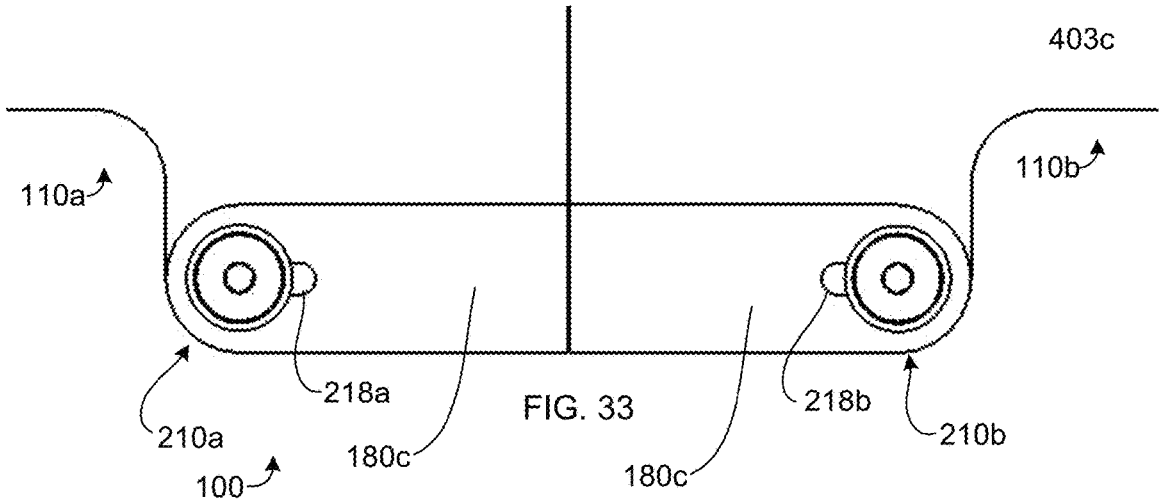
FIG. 33 illustrates a fourth step showing coupling of turn pin lock assemblies to associated components, according to an alternative embodiment of the invention.

As illustrated in FIGS. 30A-30C, first and second turn pin lock assemblies 210*a* and 210*b* each comprise: bolt 105, stop head 160, a slotted spring pin 211, and a turn pin 212. Slotted spring pin 211 may comprise a loaded spring portion that permits slotted spring pin 211 to shorten with respect to its axial length when acted upon by an axial force, and return to initial elongated position upon removal of the same axial force. Turn pin 212 may include a turn pin body 213 and bullet end 106. Turn pin body 213 may be distinguished in that it forms a substantially uniform diameter throughout the entirety of the pin's length (compare to drop pin 107 of FIGS. 8A-8C).

Figure 29:
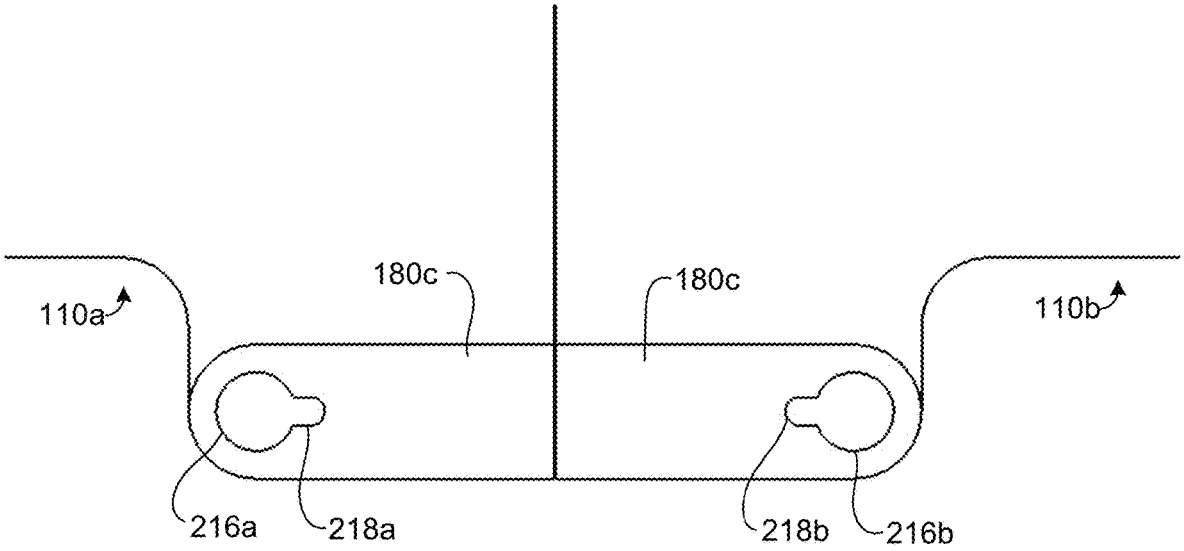
FIG. 29 illustrates a top view of first and second base portions, according to an alternative embodiment of the invention.

The method of assembling the separable base plate assembly 100 may be conducted substantially similar to the previously described first and second steps 400 and 401 as shown in FIGS. 11-13. However, in this alternative embodiment in a third step 402*c*, first and second slotted spring pin assemblies, 210*a* and 210*b*, are fully inserted. During insertion defined by third step 402*c*, the slotted spring pin 211 of the first slotted spring pin assembly 210*a* is aligned with the first slotted spring pin opening 218*a*. By the same token, the slotted spring pin 211 of the second slotted spring pin assembly 210*b* is aligned with the second slotted spring pin opening 218*b*. The first and second slotted spring pin openings, 218*a* and 218*b*, are shown in FIG. 29. Also during insertion as defined by third step 402*c*, slotted spring pins 211 are sized to come in contact with turn pin projection assembly 180*c*, such that the slotted spring pins 211 provide resistance along the axial direction (relative to the turn pin 212) as the slotted spring pins 211 reach the first and second slotted spring pin openings, 218*a* and 218*b*, akin to a clicking motion, in the initial elongated position. The slotted spring pins then retract, allowing first and second turn pin assemblies, 210*a* and 210*b*, to be fully inserted. In one aspect, the intent of this design is to provide the person assembling separable base plate assembly 100 with a tactile response, indicating to the person that the first and second turn pin assemblies, 210*a* and 210*b*, have been properly inserted. Then, in a fourth step 403*c*, first and second turn pin lock assemblies, 210*a* and 210*b*, are respectively turned in the radial direction (again, relative to the turn pin 212) so that the slotted spring pins 211 become radially offset from first and second slotted spring pin openings, 218*a* and 218*b*. By this method, first and second base portions, 110*a* and 110*b*, are rigidly coupled via first and second turn pin lock assemblies, 210*a* and 210*b*, clamp assembly 150, and associated components, as shown in, for example, FIGS. 28 and 33.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A device for clamping to the side rail of an operating table, the device comprising:

a separable base plate including:

first and second base portions, wherein each of said first and said second base portions comprises a flat upper base surface, a flat lower base surface, a parallel vertical end edge disposed opposite a middle vertical surface, a cavity assembly formed within each of said first and second base portions, said cavity assembly extending inwardly from said flat lower base surface, said cavity assembly including a linearly-extruded profile extending inwardly from said middle vertical surface toward said parallel vertical end edge, and a projection assembly extending outwardly from said flat upper base surface;

a first track portion rigidly connected to, and offset from, said first base portion, a second track portion rigidly connected to, and offset from, said second base portion, each of said first and second track portions being configured to receive a carriage assembly and provide for slidable locking of the same at discrete locations along said first and second track portions;

a base plate connector having a complementary profile, said base plate connector configured to be received within said cavity assembly of each of the first and second base plate portions wherein said complementary profile substantially conforms to said linearly-extruded profile of said cavity assembly, such that said middle vertical surface of each of said first and second base plate portions mate each other in the assembled configuration;

first and second drop pin assemblies, wherein each drop pin assembly comprises a lower body portion having a first diameter, and a stop head having a second diameter, said stop head disposed at an end of said lower body portion, said first and second drop pin assemblies configured to be received by said projection assembly and operatively connect to a clamp connected to the side rail.

2. The device of claim 1 wherein said linearly-extruded profile of said cavity assembly comprises a T-shape including a cavity top, an upper vertical cavity surface, an opposite upper vertical cavity surface, a lateral cavity surface, an opposite lateral cavity surface, a lower vertical cavity surface, and an opposite lower vertical cavity surface.

3. The device of claim 1 wherein said complementary profile of said base plate connector comprises an upper connector surface, a lower connector surface, an upper vertical connector surface, an opposite upper vertical connector surface, a lateral connector surface, an opposite lateral connector surface, a lower vertical connector surface, and an opposite lower vertical connector surface.

4. The device of claim 1 wherein said cavity assembly further comprises a first set screw disposed within said first base plate portion and a second set screw disposed within said second base plate portion, said first and second base plate portions configured to inhibit translation of said base plate connector within said cavity assembly, when said middle vertical surface of each of said first and second base plate portions mate each other in the assembled configuration.

5. The device of claim 1 wherein said first and second drop pin assemblies each further comprise a bolt configured to fixedly attach said stop head to said lower body portion.

6. The device of claim 1 wherein said first and second drop pin assemblies each further comprise an upper drop pin portion disposed between said lower body portion and said stop head, said upper drop pin portion having a third diameter.

7. The device of claim 6 wherein said projection assembly further comprises:

a pin flange disposed on each of said first and said second base portions, said pin flange having a pin flange opening extending through said projection assembly and extending through each of said first and said second base portions from said flat upper base surface to said flat lower base surface;

and a bolt flange disposed on each of said first and said second base portions, said bolt flange having a threaded bolt flange opening extending at least partially through said projection assembly.

8. The device of claim 7 further comprising:

a slide lock comprising a body portion including first and second pin receiver assemblies having first openings and second openings, wherein said slide lock is configured to be positioned adjacent said projection assembly such that said first openings align with said pin flange openings of said first and second base portions when said slide lock is moved into a first position, said first position further characterized in that said drop pin assemblies are configured to be received through said first openings and through said pin flange openings so that said stop head is disposed adjacent to said slide lock in a fully inserted configuration, and wherein said slide lock is configured to slide into a second position, said second position characterized by aligning said second openings of said slide lock with said upper drop pin portion, said second openings configured to operably receive said third diameter, so that said first and second base portions become rigidly attached to the side rail of the operating table when said lower body portions are received and secured by the clamp.

9. The device of claim 8 wherein said slide lock further comprises first and second L-shaped nut receiver assemblies, each of said first and second L-shaped nut receiver assemblies including a mid-portion.

10. The device of claim 9 further comprising first and second bolts, said first and second bolts being configured to be received by said threaded bolt flange openings of said first and second base portions, said first bolt being configured to operably connect to said first L-shaped nut receiver assembly, and said second bolt being configured to operably connect to said second L-shaped nut receiver assembly.

11. The device of claim 6 wherein said projection assembly further comprises:

a spring-loaded projection assembly disposed on each of said first and said second base portions, said spring-loaded projection assembly including a bolt opening extending through said projection assembly and extending through each of said first and said second base portions from said flat upper base surface to said flat lower base surface, a recessed portion formed at least partially within said projection assembly, and a spring abutment formed at least partially within said projection assembly; and first and second spring-loaded lock assemblies, configured to be received by said first and second base portions via said spring-loaded projection assemblies, each spring-loaded lock assembly including:

a latch having a pivot portion, an engagement portion, a latch portion having an arcuate surface configured to operably receive said third diameter, and a spring receiver portion; and a spring configured to be received by said spring abutment at a first spring end and by said spring receiver portion at a second spring end;

said first and second spring-loaded lock assemblies being configured to be received within said recessed portion, wherein, in a first spring-loaded position, said first and second spring-loaded lock assemblies are configured to rotate about said pivot portions to allow said first and second drop pin assemblies to be received through said bolt openings, when said first and second spring-loaded lock assemblies are acted upon by force exerted at said engagement portion, and wherein, in a second spring-loaded position, said first and second spring-loaded lock assemblies are configured to engage said upper drop pin portion of said first and second drop pin assemblies, so that said first and second base portions become rigidly attached to the side rail of the operating table when said lower body portions are received and secured by the clamp.

12. The device of claim 1 wherein said first and said second drop pin assemblies each further comprise a slotted spring pin disposed on, and extending radially outward from, said lower body portion.

13. The device of claim 12 wherein said projection assembly further comprises:

a turn pin opening disposed on each of said first and said second base portions, said turn pin opening extending through said projection assembly and extending through each of said first and said second base portions from said flat upper base surface to said flat lower base surface; and a slotted spring pin opening disposed on each of said first and said second base portions, said slotted spring pin opening extending through said projection assembly and extending through each of said first and said second base portions from said flat upper base surface to said flat lower base surface, wherein, in a first turn pin position characterized by said slotted spring pin being radially aligned with said slotted spring pin opening, said first and said second drop pin assemblies are configured to be received by said projection assembly, and wherein, in a second turn pin position characterized by said slotted spring pin being radially misaligned with said slotted spring pin opening, said slotted spring pin operably engages said first and said second flat lower base surfaces of said first and said second base portions, so that said first and second base portions become rigidly attached to the side rail of the operating table when said lower body portions are received and secured by the clamp.

14. A method of assembling a device for clamping to the side rail of an operating table, the method comprising:

providing:

a separable base plate including:

first and second base portions, wherein each of said first and said second base portions comprises a flat upper base surface, a flat lower base surface, a parallel vertical end edge disposed opposite a middle vertical surface, a cavity assembly formed within each of said first and second base portions, said cavity assembly extending inwardly from said flat lower base surface, said cavity assembly including a linearly-extruded profile extending inwardly from said middle vertical surface toward said parallel vertical end edge, and a projection assembly extending outwardly from said flat upper base surface;

a first track portion rigidly connected to, and offset from, said first base portion, a second track portion rigidly connected to, and offset from, said second base portion, each of said first and second track portions being configured to receive a carriage assembly and provide for slidable locking of the same at discrete locations along said first and second track portions; and a base plate connector having a complementary profile, said base plate connector configured to be received within said cavity assembly of each of the first and second base plate portions wherein said complementary profile substantially conforms to said linearly-extruded profile of said cavity assembly;

connecting said first and second base portions together via said base plate connector, such that said middle vertical surfaces operably connect to form a unitary base plate; and securing said unitary base plate to the side rail of an operating table.

15. The method of assembling a device for clamping to the side rail of an operating table according to claim 14, said projection assembly further comprising a pin flange disposed on each of said first and said second base portions, said pin flange having a pin flange opening extending through said projection assembly and extending through each of said first and said second base portions from said flat upper base surface to said flat lower base surface, and a bolt flange disposed on each of said first and said second base portions, said bolt flange having a threaded bolt flange opening extending at least partially through said projection assembly.

16. The method of assembling a device for clamping to the side rail of an operating table according to claim 15, wherein the step of securing said unitary base plate to the side rail of an operating table further comprises the steps of:

providing first and second bolts;

threading said first and second bolts into each threaded bolt flange opening of said first and second base portions;

providing a slide lock, said slide lock comprising a body portion including first and second pin receiver assemblies and first and second L-shaped nut receiver assemblies, said first and second pin receiver assemblies having first openings and second openings, and said first and second L-shaped nut receiver assemblies having a mid-portion;

sliding said slide lock to a first position, characterized by locating said first and second bolts at said mid-portions of said first and second L-shaped nut receiver assemblies;

providing first and second drop pin assemblies, wherein each drop pin assembly comprises a lower body portion having a first diameter, a stop head having a second diameter, said stop head disposed at an end of said lower body portion, and an upper drop pin portion disposed therebetween, said upper drop pin portion having a third diameter;

inserting said first and second drop pin assemblies into said pin flange openings of said first and second base portions so that said stop head of said first and second drop pin assemblies operably connects with said body portion of said slide lock; and sliding said slide lock into a second position from said first position, said second position characterized by said second openings of said slide lock operably connecting with said upper drop pin portions of said first and second drop pin assemblies.

17. The method of assembling a device for clamping to the side rail of an operating table according to claim 14, said projection assembly further comprising:

a spring-loaded projection assembly disposed on each of said first and said second base portions, said spring-loaded projection assembly including a bolt opening extending through said projection assembly and extending through each of said first and said second base portions from said flat upper base surface to said flat lower base surface, a recessed portion formed at least partially within said projection assembly, and a spring abutment formed at least partially within said projection assembly; and first and second spring-loaded lock assemblies, configured to be received by said first and second base portions via said spring-loaded projection assemblies, each spring-loaded lock assembly including:

a latch having a pivot portion, an engagement portion, a latch portion having an arcuate surface configured to operably receive said third diameter, and a spring receiver portion; and a spring configured to be received by said spring abutment at a first spring end and by said spring receiver portion at a second spring end;

said first and second spring-loaded lock assemblies being configured to be received within said recessed portion.

18. The method of assembling a device for clamping to the side rail of an operating table according to claim 17, wherein the step of securing said unitary base plate to the side rail of an operating table further comprises the steps of:

providing first and second drop pin assemblies, wherein each drop pin assembly comprises a lower body portion having a first diameter, a stop head having a second diameter, said stop head disposed at an end of said lower body portion, and an upper drop pin portion disposed therebetween, said upper drop pin portion having a third diameter, exerting a force on said engagement portions of each of said first and second spring-loaded lock assemblies;

inserting said first and second drop pin assemblies into said bolt openings of said first and second base portions; and removing said exerted force from said engagement portions, allowing said arcuate surface of said latches to operably connect with said upper drop pin portions of said first and second drop pin assemblies.

19. The method of assembling a device for clamping to the side rail of an operating table according to claim 14, said projection assembly further comprising:

a turn pin opening disposed on each of said first and said second base portions, said turn pin opening extending through said projection assembly and extending through each of said first and said second base portions from said flat upper base surface to said flat lower base surface; and a slotted spring pin opening disposed on each of said first and said second base portions, said slotted spring pin opening extending through said projection assembly and extending through each of said first and said second base portions from said flat upper base surface to said flat lower base surface.

20. The method of assembling a device for clamping to the side rail of an operating table according to claim 19, wherein the step of securing said unitary base plate to the side rail of an operating table further comprises the steps of:

providing first and second drop pin assemblies, wherein each drop pin assembly comprises a lower body portion having a first diameter, a stop head having a second diameter, said stop head disposed at an end of said lower body portion, and a slotted spring pin disposed on, and extending radially outward from, said lower body portion;

inserting, fully, said first and second drop pin assemblies into said turn pin openings of each of said first and second base portions, said slotted spring pins of each of said first and second drop pin assemblies being radially aligned with said slotted spring pin openings of each of said first and second base portions; and turning each of said first and second drop pin assemblies so that said slotted spring pins are radially misaligned with respective said slotted spring pin openings, said slotted spring pin operably engaging said first and said second flat lower base surfaces of said first and said second base portions, so that said first and second base portions become rigidly attached to the side rail of the operating table when said lower body portions are received and secured by a clamp connected to the side rail.

21. A device for clamping to the side rail of an operating table, the device comprising:

a separable base plate including:

a plurality of base portions, wherein each base portion comprises a flat upper base surface, a flat lower base surface, a first vertical surface disposed opposite a second vertical surface, a cavity assembly formed within each base portion, said cavity assembly extending inwardly from said flat lower base surface, said cavity assembly including a linearly-extruded profile extending inwardly from said second vertical surface through to said first vertical surface, and a projection assembly extending outwardly from said flat upper base surface;

a track portion rigidly connected to, and offset from, each base portion, said track portion configured to receive the carriage assembly and provide for slidable locking of a same at discrete locations along said track portions;

at least one base plate connector having a complementary profile, said at least one base plate connector configured to be received within said cavity assembly of each of said plurality of base portions wherein said complementary profile substantially conforms to said linearly-extruded profile of said cavity assembly, such that said second vertical surface of each successive base plate portion operably connects to said first vertical surface within the series of said connected plurality of base portions; and a plurality of drop pin assemblies, wherein each drop pin assembly comprises a lower body portion having a first diameter, and a stop head having a second diameter, said stop head disposed at an end of said lower body portion, each of said drop pin assemblies configured to be received by said projection assembly and operatively connect to a clamp connected to the side rail.

* * * * *